US009800005B2

(12) United States Patent
Fransen et al.

(10) Patent No.: US 9,800,005 B2
(45) Date of Patent: Oct. 24, 2017

(54) FRONT SLED ASSEMBLIES FOR COMMUNICATION JACKS AND COMMUNICATION JACKS HAVING FRONT SLED ASSEMBLIES

(71) Applicant: Panduit Corp., Tinley Park, IL (US)

(72) Inventors: Robert E. Fransen, Orland Park, IL (US); Satish I. Patel, Roselle, IL (US); Joshua A. Valenti, Wheeling, IL (US); Tse-Yu Lin, Cupertino, CA (US); Moulik Shah, Chicago, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 15/187,996

(22) Filed: Jun. 21, 2016

(65) Prior Publication Data

US 2016/0301171 A1 Oct. 13, 2016

Related U.S. Application Data

(63) Continuation of application No. 14/203,057, filed on Mar. 10, 2014, now Pat. No. 9,379,500.

(60) Provisional application No. 61/775,846, filed on Mar. 11, 2013.

(51) Int. Cl.

| | |
|---|---|
| ***H01R 24/00*** | (2011.01) |
| ***H01R 27/00*** | (2006.01) |
| ***H01R 13/6461*** | (2011.01) |
| ***H01R 24/64*** | (2011.01) |
| ***H01R 13/6467*** | (2011.01) |
| *H01R 107/00* | (2006.01) |

(52) U.S. Cl.
CPC ..... *H01R 27/00* (2013.01); *H01R 13/6461* (2013.01); *H01R 13/6467* (2013.01); *H01R 24/64* (2013.01); *H01R 2107/00* (2013.01); *H01R 2201/04* (2013.01)

(58) Field of Classification Search
CPC .... H01R 24/64; H01R 13/6658; H01R 24/62; H01R 13/6466; H01R 13/6461; H01R 13/6464; H01R 13/6467; Y10S 439/941; Y10S 439/942
See application file for complete search history.

(56) References Cited

U.S. PATENT DOCUMENTS

| | | | | |
|---|---|---|---|---|
| 5,310,363 | A * | 5/1994 | Brownell | H04B 3/32 439/607.01 |
| 5,647,770 | A | 7/1997 | Belopolsky | |
| 5,779,503 | A * | 7/1998 | Tremblay | H01R 13/6467 439/676 |
| 5,938,479 | A | 8/1999 | Paulson et al. | |
| 6,368,144 | B2 | 4/2002 | Viklund | |
| 6,394,853 | B1 | 5/2002 | Hammond et al. | |
| 6,409,549 | B1 | 6/2002 | Yeh | |

(Continued)

*Primary Examiner* — Xuong Chung Trans
(74) *Attorney, Agent, or Firm* — Christopher S. Clancy; James H. Williams; Ryan K. Thelen

(57) ABSTRACT

The present invention generally relates to communication connectors and internal components thereof. In one embodiment, the present invention is a communication jack comprising both front-rotated and back rotated plug interface contacts. In another embodiment, the present invention is a communication jack comprising a two-piece front sled. In yet another embodiment, the present invention is a communication jack that retains its functionality when mated with both eight-position and six-position plugs.

20 Claims, 41 Drawing Sheets

(56) References Cited

U.S. PATENT DOCUMENTS 6,431,918 B1 * 8/2002 Givens ..... H01R 13/6461 439/676
6,464,541 B1 10/2002 Hashim et al.
6,520,808 B2 2/2003 Forbes et al.
6,547,604 B2 4/2003 Arnett et al.
6,558,207 B1 5/2003 Pepe et al.
6,682,363 B1 1/2004 Chang
6,729,914 B2 5/2004 Jaouen
6,739,898 B1 5/2004 Ma et al.
6,769,937 B1 8/2004 Roberts
6,786,775 B1 9/2004 Hanrahan et al.
6,869,318 B2 3/2005 Viklund et al.
6,896,557 B2 5/2005 Aekins et al.
6,916,209 B1 7/2005 Casher et al.
7,134,904 B2 11/2006 Bergner et al.
7,153,168 B2 12/2006 Caveney et al.
7,166,000 B2 1/2007 Pharney
7,182,649 B2 2/2007 Caveney et al.
7,249,979 B2 7/2007 Gerber et al.
7,309,261 B2 12/2007 Caveney et al.
7,341,493 B2 * 3/2008 Pepe ..... H01R 13/506 439/676
7,374,459 B2 5/2008 Lin
7,384,315 B2 6/2008 Caveney et al.
7,407,417 B2 8/2008 Pepe et al.
7,442,092 B2 10/2008 Caveney et al.
7,481,678 B2 1/2009 Aekins
7,481,681 B2 1/2009 Caveney et al.
7,485,010 B2 2/2009 Aekins
7,503,810 B1 3/2009 Goodrich et al.
7,520,784 B2 4/2009 Caveney et al.
7,540,789 B2 6/2009 Gerber et al.
7,591,689 B2 9/2009 Caveney et al.
7,601,034 B1 10/2009 Aekins et al.
7,628,656 B2 12/2009 Shields et al.
7,658,648 B2 2/2010 Aekins
7,686,649 B2 3/2010 Pepe et al.
7,726,018 B2 6/2010 Caveney et al.
RE41,700 E 9/2010 Viklund et al.
7,824,231 B2 11/2010 Marti et al.
7,927,152 B2 4/2011 Pepe et al.
7,967,644 B2 6/2011 Pepe et al.
7,976,348 B2 7/2011 Aekins et al.
8,100,701 B2 1/2012 Gerber et al.
8,187,040 B2 5/2012 Pepe et al.
8,758,063 B2 * 6/2014 Zhang ..... H01R 13/405 439/676
2007/0059988 A1 3/2007 Bolouri-Saransar
2012/0202389 A1 8/2012 Erickson

* cited by examiner

FRONT SLED ASSEMBLIES FOR COMMUNICATION JACKS AND COMMUNICATION JACKS HAVING FRONT SLED ASSEMBLIES

CROSS-REFERENCE TO RELATED APPLICATIONS

This application is a continuation of U.S. application Ser. No. 14/203,057 filed Mar. 10, 2014, which will issue as U.S. Pat. No. 9,379,500 on Jun. 28, 2016, which claims priority to U.S. Provisional Patent Application No. 61/775,846, filed on Mar. 11, 2013, each of which is incorporated herein by reference in its entirety.

FIELD OF INVENTION

The present invention generally relates to the field of communication connectors, and more specifically to plug interface contact arrangements, front sled subassemblies having plug interface contacts for use with communication jacks, and communication jacks which employ such front sled assemblies.

BACKGROUND

Communication connectors, such as RJ45 jacks, have been and continue to be readily employed in the communication industry. These jacks generally comprise a housing having an aperture for receiving a corresponding plug at one end, a means for terminating a communication cable at another end, and a means for transferring electrical signals between the plug and the communication cable.

In an RJ45 jack, the means for transferring the electrical signals typically include eight plug interface contacts (PICs). While the eight PICs are designed to interface eight plug contacts positioned in an eight-position RJ45 plug, respectively, it is also possible to connect a six-position plug (e.g., RJ12, RJ25) to an RJ45 jack. However, when compared to an eight-position plug, plug contacts 1 and 8 do not exist in a six-position plug. Therefore, in the locations where the plug contacts are not present, the jack PICs must undergo greater deflection as compared to locations where the plug contacts do exist. This additional deflection can cause the outer PICs to plastically deform and cause damage (or otherwise prevent operation within certain specifications) to the jack if the deformation is significant enough.

Additionally, in some instances the positioning/arrangement of the PICs may have some effect on the amount of crosstalk produced within the plug/jack combination and/or how the crosstalk is compensated for. This can particularly be influenced by the proximity of the plug/jack mating point and the compensation network within the jack.

Thus there exists a need for communication jacks with improved designs for plug interface contacts and corresponding compensation methods.

SUMMARY

Accordingly, embodiments of the present invention are directed to communication connectors and/or internal components thereof.

In one embodiment, the present invention is a communication jack comprising both front-rotated and back rotated plug interface contacts.

In another embodiment, the present invention is a communication jack comprising a two-piece front sled.

In yet another embodiment, the present invention is a communication jack that retains its functionality when mated with both eight-position and six-position plugs.

In still yet another embodiment, the present invention is a communication connector having a housing with an aperture for receiving a plug and a plurality of plug interface contacts at least partially received in the aperture. The plurality of plug interface contacts include respective ends proximal the aperture, the plurality of plug interface contacts have respective ends distal the aperture, the distal ends fixed within the connector, the proximal ends being supported and rotating relative to the distal ends, the proximal end including a spring section. In a variation of this embodiment, the communication connector is used in a communication system.

In still yet another embodiment, the present invention is a communication connector having a housing with an aperture for receiving a plug and a plurality of plug interface contacts at least partially received in the aperture. The plurality of plug interface contacts include respective ends proximal the aperture, the plurality of plug interface contacts have respective ends distal the aperture, the distal ends fixed within the connector, the proximal ends rotating relative to the distal ends, the proximal end including a contact zone, the contact zone being supported by a spring.

These and other features, aspects, and advantages of the present invention will become better understood with reference to the following drawings, description, and any claims that may follow.

DETAILED DESCRIPTION

Figure 1:
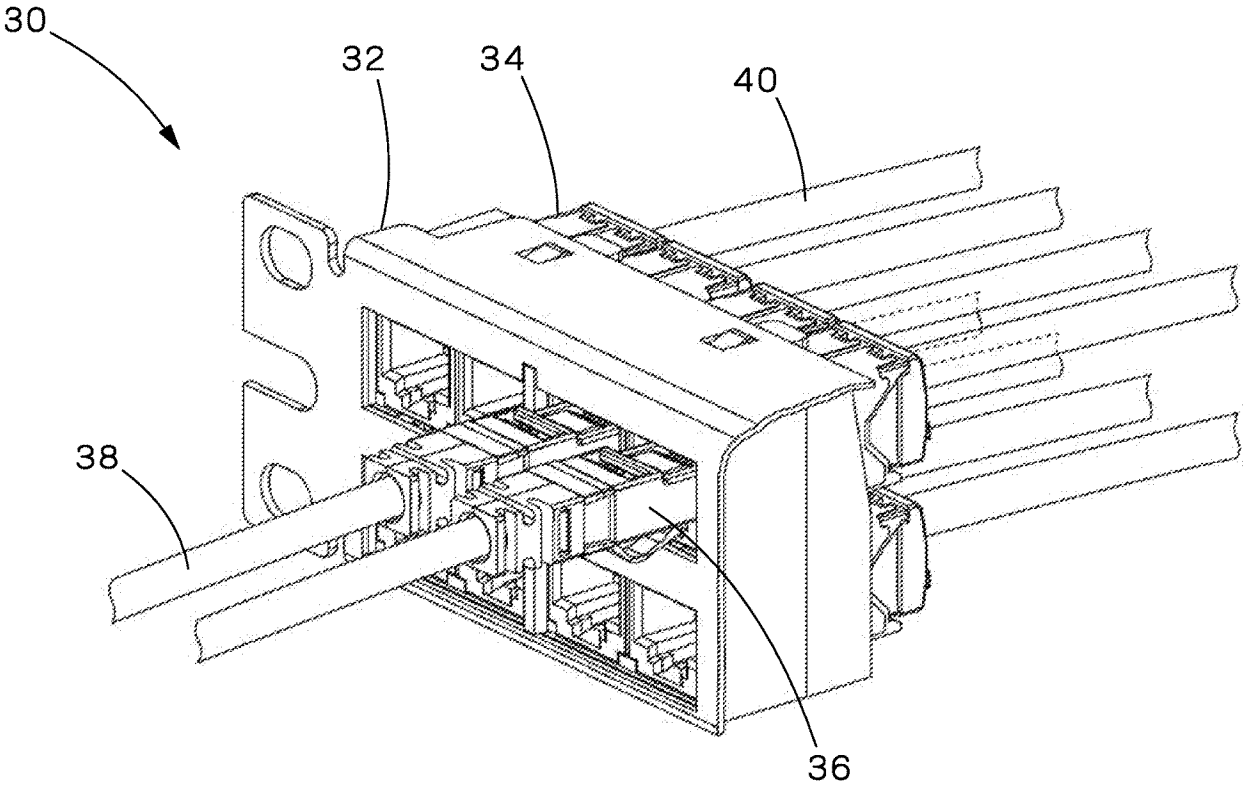
FIG. 1 illustrates a communication system according to an embodiment of the present invention.

An exemplary embodiment of the present invention is illustrated in FIG. 1, which shows a communication system 30, which includes a patch panel 32 with jacks 34 and corresponding RJ45 plugs 36. Respective cables 38 are terminated to plugs 36, and respective cables 40 are terminated to jacks 34. Once a plug 36 mates with a jack 34 data can flow in both directions through these connectors. Although the communication system 30 is illustrated in FIG. 1 as having a patch panel, alternative embodiments can include other active or passive equipment. Examples of passive equipment can be, but are not limited to, modular patch panels, punch-down patch panels, coupler patch panels, wall jacks, etc. Examples of active equipment can be, but are not limited to, Ethernet switches, routers, servers, physical layer management systems, and power-over-Ethernet equipment as can be found in data centers and or telecommunications rooms; security devices (cameras and other sensors, etc.) and door access equipment; and telephones, computers, fax machines, printers, and other peripherals as can be found in workstation areas. Communication system 30 can further include cabinets, racks, cable management and overhead routing systems, and other such equipment.

Figure 2:
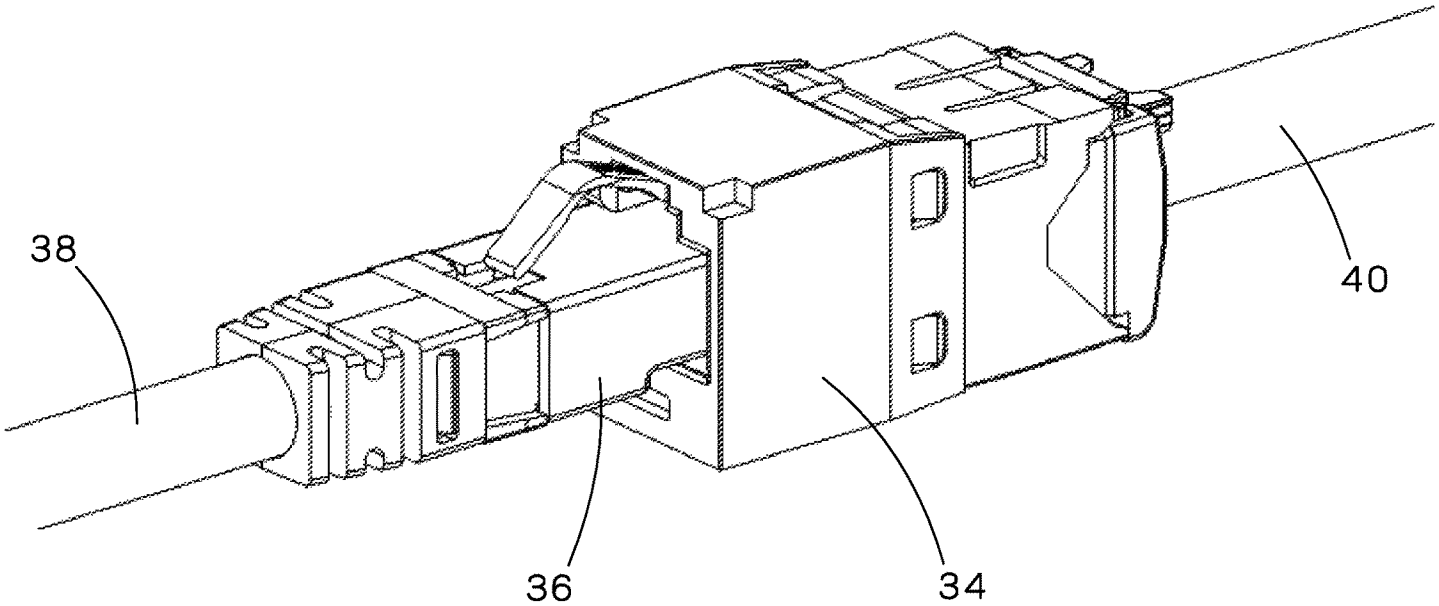
FIG. 2 illustrates a plug and jack combination according to an embodiment of the present invention.

The jack and plug combination of FIG. 1 is also shown in FIG. 2 which illustrates the network jack 34 mated with the RJ45 plug 36. Note that in this figure, the orientation of the network jack 34 and the RJ45 plug 36 is rotated 180° about the central axis of cable 40 as compared to the orientation of FIG. 1.

Figure 3:
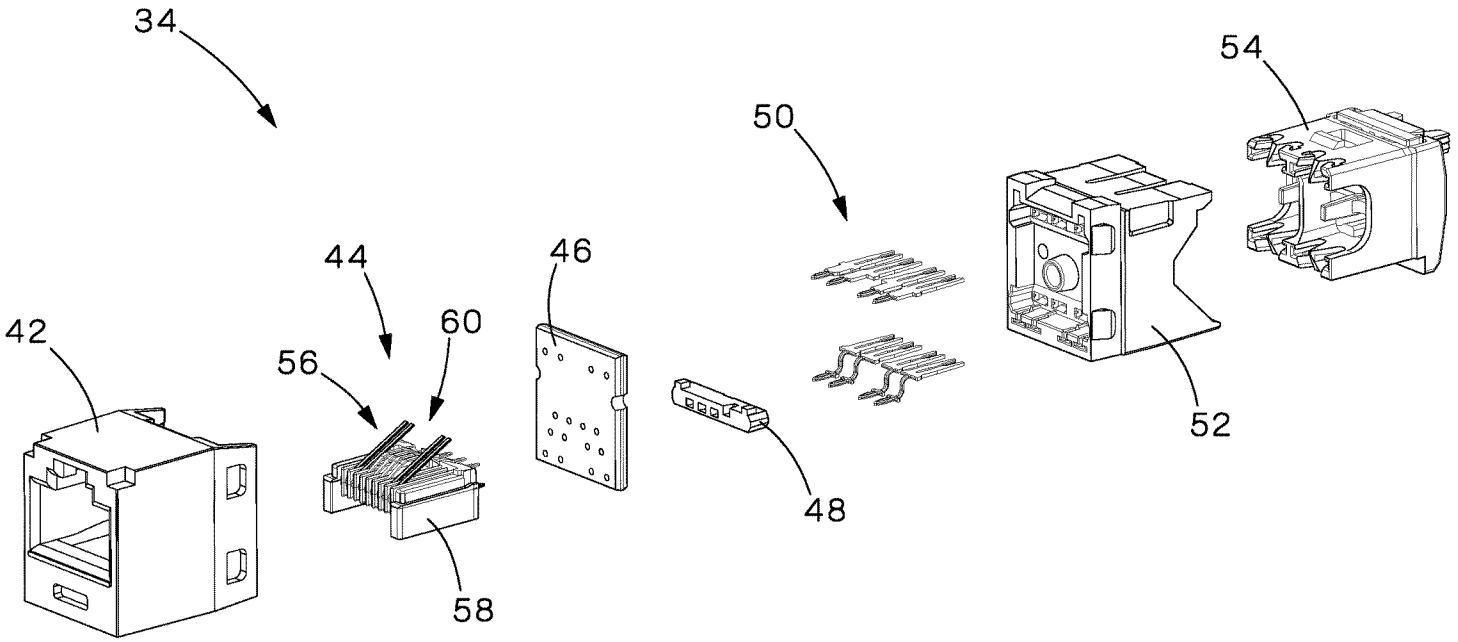
FIG. 3 illustrates an exploded view of a communication jack according to an embodiment of the present invention.

FIG. 3 illustrates an exploded view of the network jack 34, which includes a front housing 42, a front sled subassembly 44, a printed circuit board (PCB) 46 (which in some embodiments may have crosstalk compensation components thereon), an insulation displacement contact (IDC) support 48, IDCs 50, a rear housing 52, and a wire cap 54. In the currently described embodiment, the front sled subassembly 44 includes a first set of PICs 56 and a second set of PICs 60, and a front sled 58 which can be made from any suitable material including, but not limited to, plastic. In alternate embodiments, jack 34 can additionally include alien crosstalk-reducing materials such as a foil.

Figure 4A:
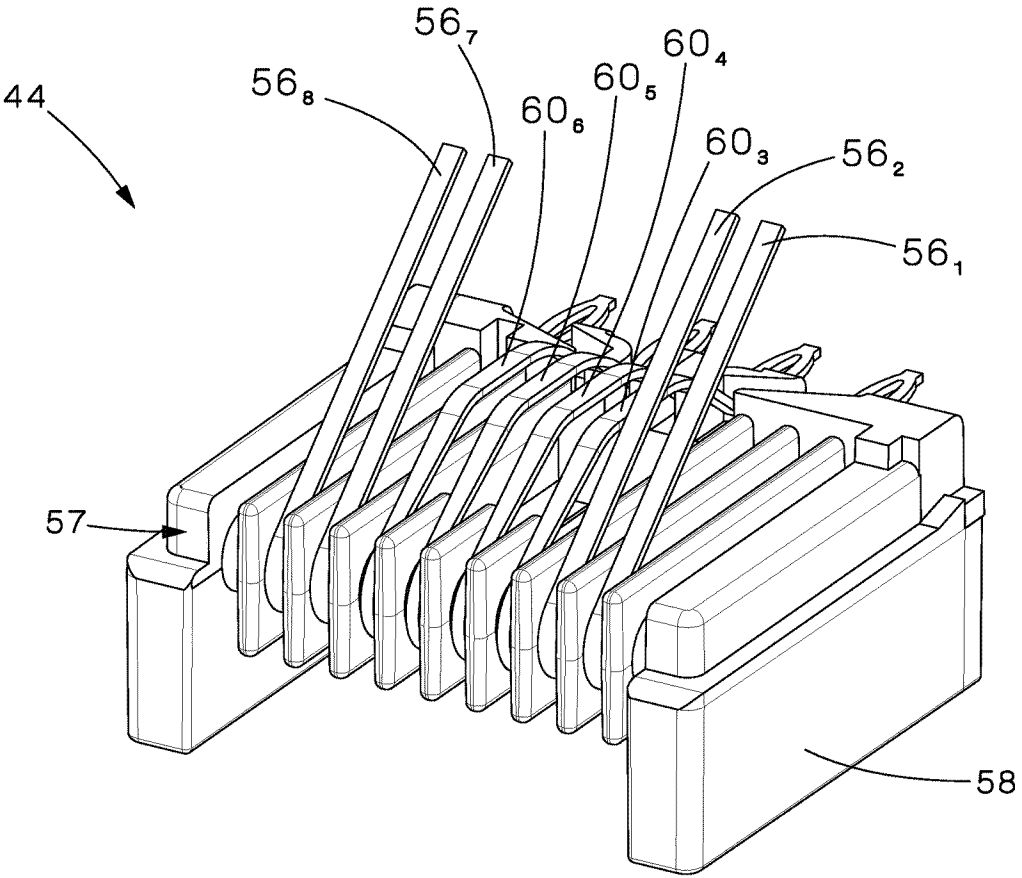
FIG. 4A illustrates a front perspective view of a front sled subassembly according to an embodiment of the present invention.
Figure 4B:
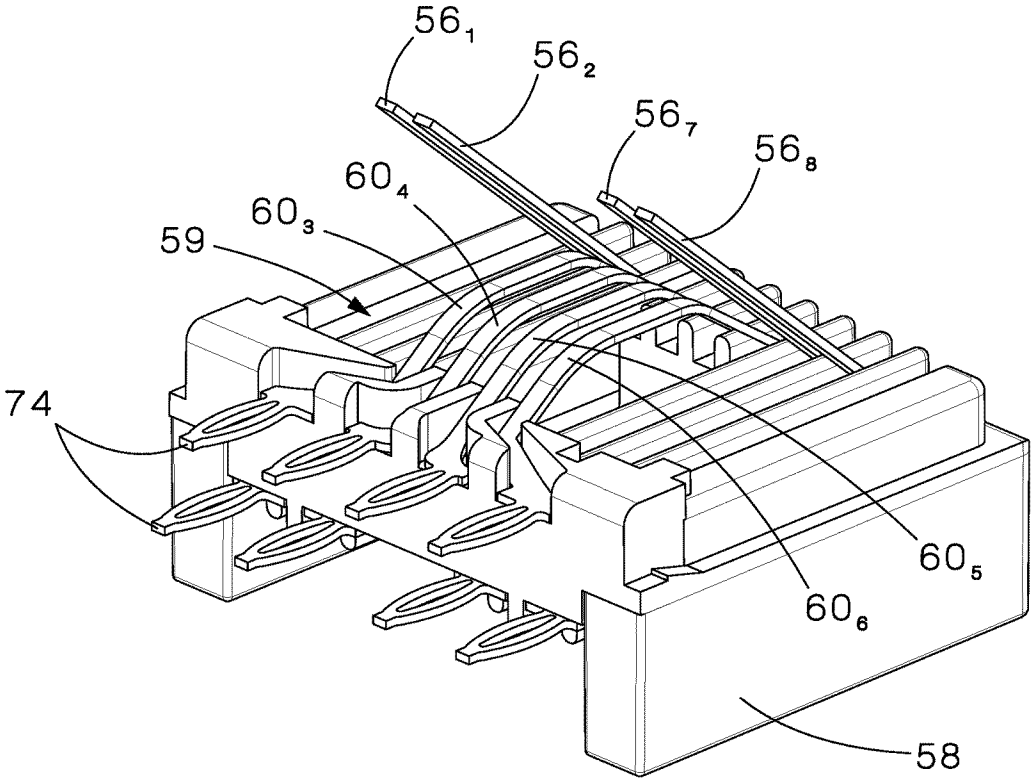
FIG. 4B illustrates a rear perspective view of the front sled subassembly of FIG. 4A.
Figure 4C:
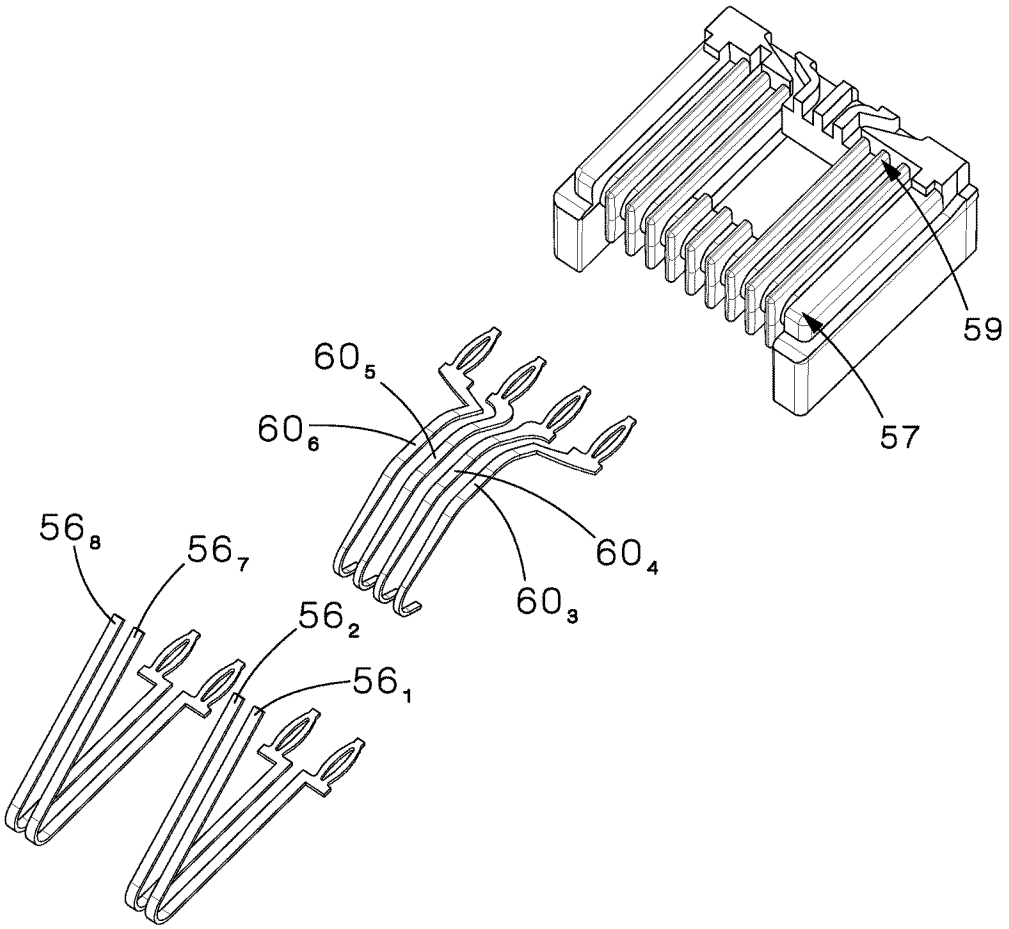
FIG. 4C illustrates an exploded view of the front sled subassembly of FIG. 4A.
Figure 4E:
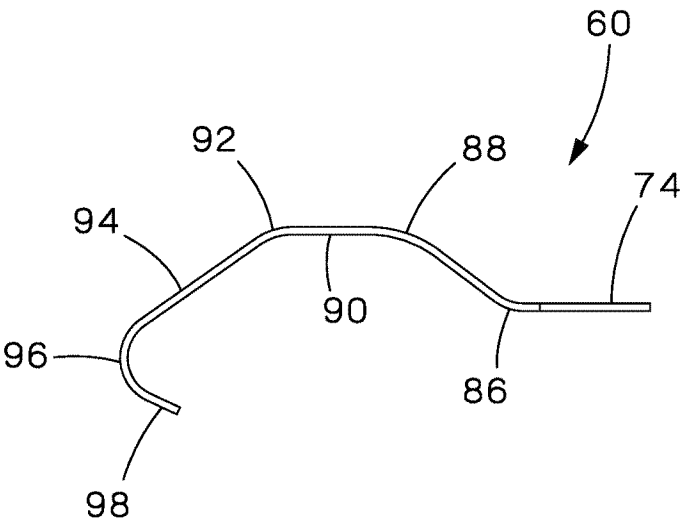
FIGS. 4D and 4E illustrate side profiles of plug interface contacts of the front sled subassembly of FIG. 4A.
Figure 4D:
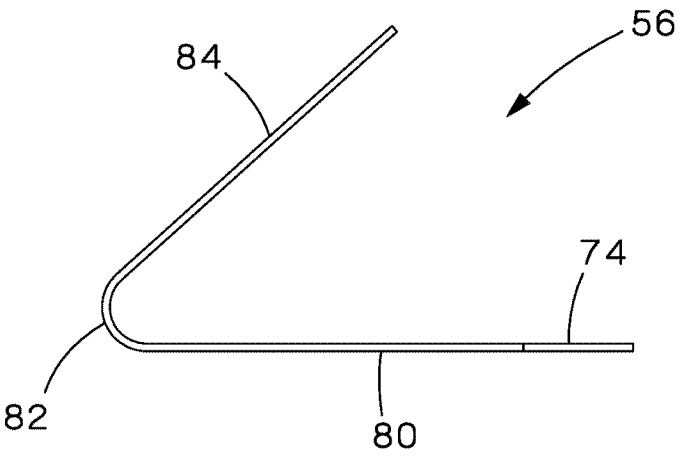

FIGS. 4A, 4B, and 4C illustrate the front sled subassembly 44 with PICs 56,60 and the front sled 58 in greater detail. The subscript numbers for each PIC 56 and 60 correspond to the RJ45 pin positions as defined by ANSI/TIA-568-C.2. As shown in FIG. 4C, PICs 56 have a configuration that is different from the configuration of PICs 60. More specifically, PICs 56 may be referred to as "front-rotated," implying that those PICs generally flex about the front region 57 of the sled 58 when mated to a corresponding plug. FIG. 4D illustrates a side profile of one of the PICs 56 (which is representative of the side profile of all the PICs 56). Each PIC 56 includes a compliant pin 74, a lower beam section 80, a free end section 84, and a flex section 82 connecting the lower beam section 80 and the free end section 84.

The front-pivoting design of PICs 56 may allow the free ends 84 to undergo a greater degree of downward deflection prior to plastic deformation while also maintaining an acceptable normal force with an eight-position RJ45 plug interface. These features may be helpful in allowing a jack to retain its functionality after mating with a six-position plug which deflects PICs $\mathbf{56}_1$ and $\mathbf{56}_8$ to a degree that is greater than the remaining PICs. Likewise, these features may also be helpful in allowing a jack to retain its functionality after mating with a four-position plug (e.g., RJ9) which deflects PICs $\mathbf{56}_1$, $\mathbf{56}_2$, $\mathbf{56}_7$, and $\mathbf{56}_8$ to a degree that is greater than the remaining PICs.

The second set of PICs (PICs 60) may be referred to as "back-rotated," implying that those PICs generally flex in the rear section 59 of the sled 58. FIG. 4E illustrates a side profile of one of the PICs 60 (which is representative of the side profile of all the PICs 60). Each PIC 60 includes a compliant pin 74, a first flex section 86, a second flex section 88, an upper beam portion 90, a first linking section 92 which links the upper beam portion 90 to a leg 94, and a second linking portion 96 which links the leg 94 to a free end 98.

The design of PICs 60 allows RJ45 pairs 4:5 and 3:6 to have a shorter electrical path from the plug contacts of the plug 36 to the PCB 46. The shortened distance may help to reduce or otherwise assist in reducing undesired crosstalk which can originate and/or occur on the 4:5 and 3:6 pairs.

Figure 5:
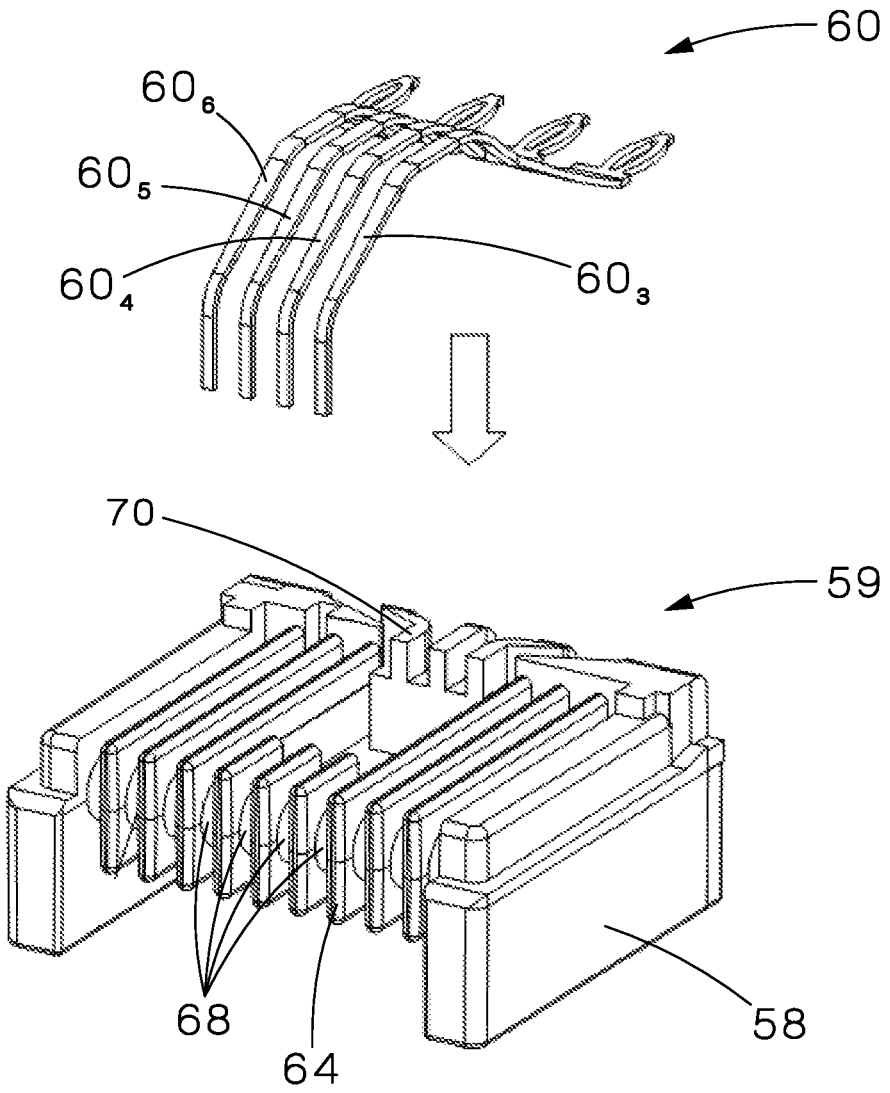
FIG. 5 illustrates a step in the assembly process of the front sled subassembly of FIG. 4A.
Figure 6A:
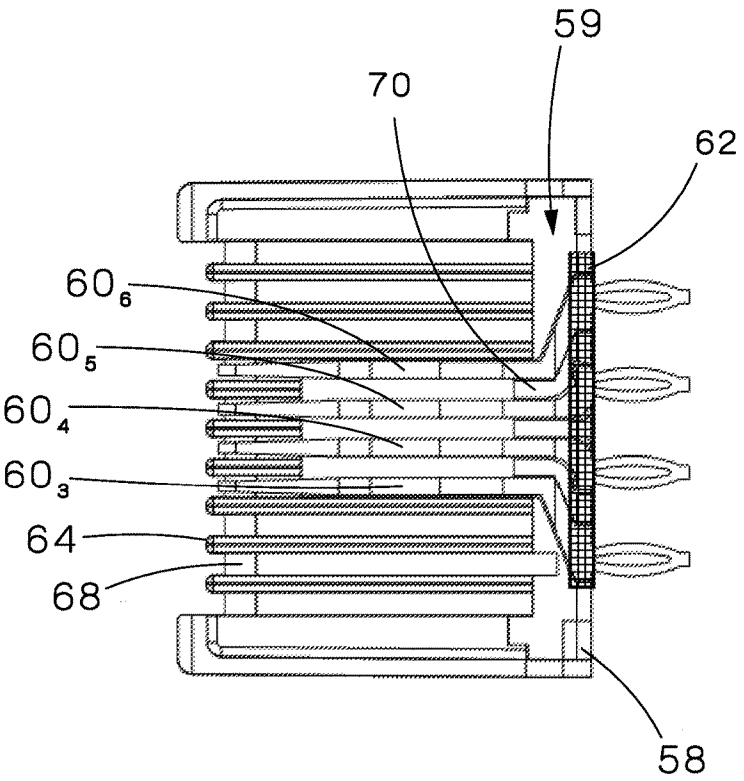
FIGS. 6A and 6B illustrate another step in the assembly process of the front sled subassembly of FIG. 4A.
Figure 6B:
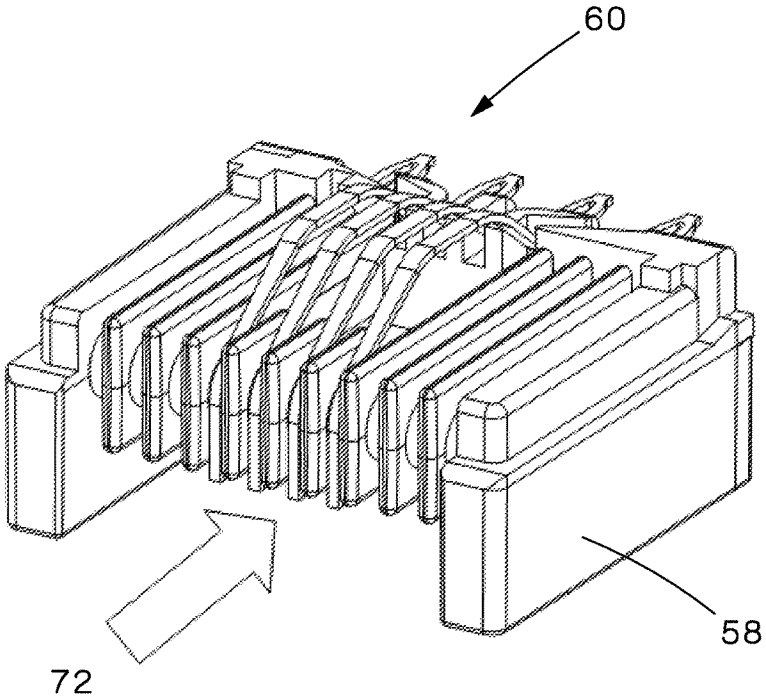

FIGS. 5-8 illustrate the assembly of the front sled subassembly 44 in accordance with one embodiment. Note that while a certain order of assembly is described, one of ordinary skill will recognize that the order of at least some steps of the assembly process may be varied. The front sled subassembly 44 is fabricated by first inserting partially formed PICs 60 into the front sled 58. As shown in FIG. 5, the PICs 60 are inserted from the top portion of the front sled 58. A front sled front comb 64 and a front sled rear comb 70 separate each PIC from adjacent PICs. When inserted into the sled 58, PICs 60 are at least partially supported by the rear section 59. The PICs 60 are further secured at the rear section 59 via securing features 62, as shown in FIG. 6A. In some embodiments, securing feature 62 may be a staking feature. To finalize the assembly of the PICs 60, the second linking portions 96 and the free ends 98 of PICs 60 are wrapped around mandrels 68, as shown in FIG. 6B, to create front wraps 72. The front wraps 72 and the securing feature 62 provide at least some restrains for the PICs 60, holding them in position and reducing or eliminating unwanted degrees of freedom. Additionally, the front wraps 72 keep the PICs 60 from buckling inward during plug insertion by preventing the PICs 60 from moving in a backward direction.

Figure 7:
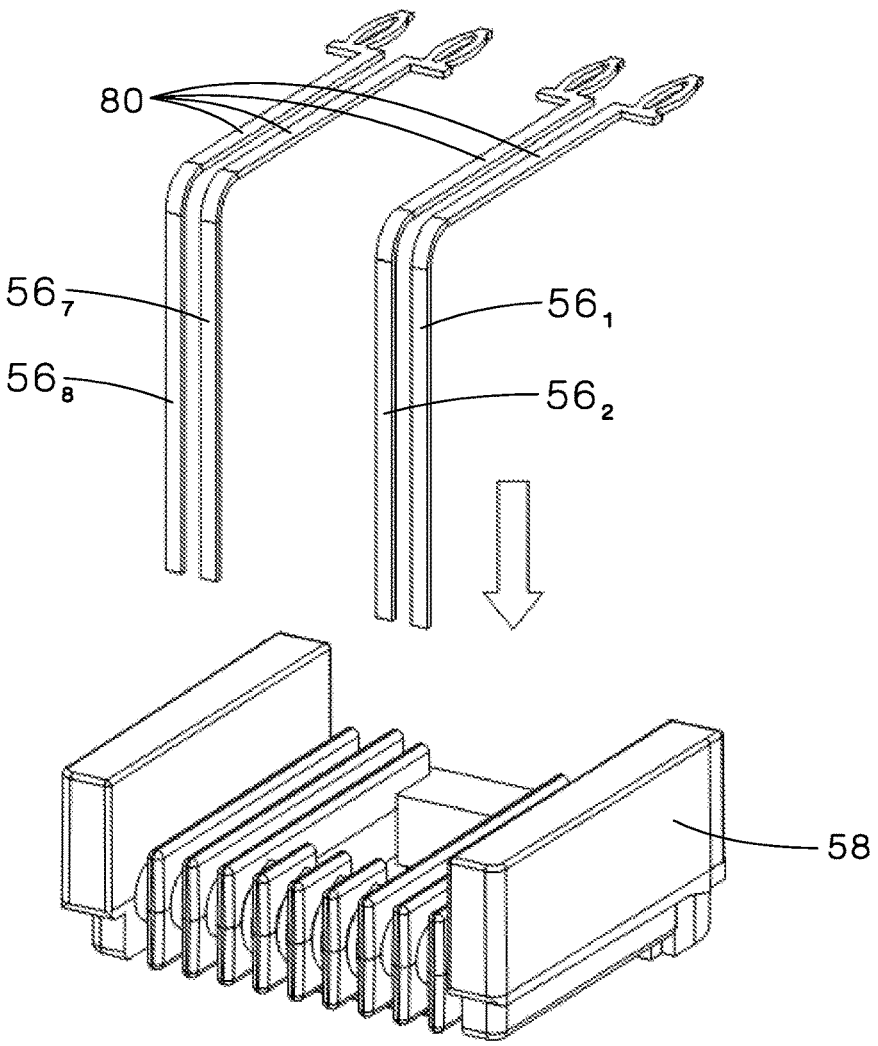
FIG. 7 illustrates yet another step in the assembly process of the front sled subassembly of FIG. 4A.
Figure 8A:
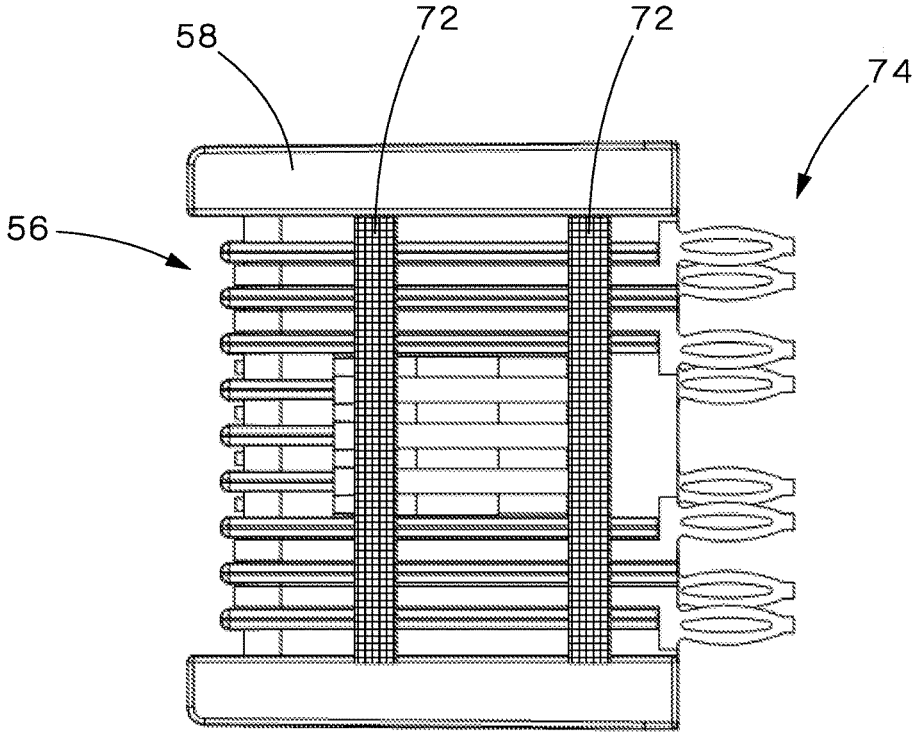
FIGS. 8A and 8B illustrate still yet another step in the assembly process of the front sled subassembly of FIG. 4A.
Figure 8B:
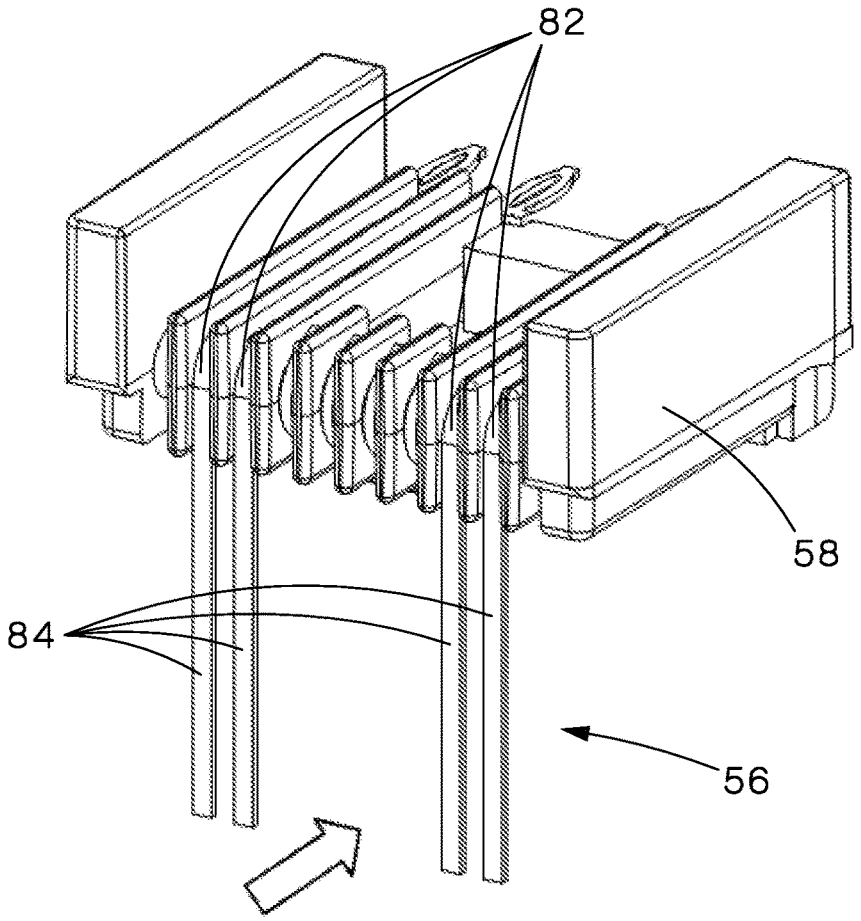

After PICs 60 are assembled, PICs 56 are joined to the front sled 58, as shown in FIG. 7, such that the lower beam sections 80 run along the bottom of the front sled 58. When the PICs 56 are fully joined to the front sled 58, they are secured by at least one securing feature 72 as shown in FIG. 8A. Thereafter, the flex sections 82 and free ends 84 are wrapped around the front mandrels 68 as shown by the directional arrow in FIG. 8B.

Once both sets of PICs 56 and 60 have been assembled to the front sled 58 they are attached to the PCB 46 via the compliant pins 74. Thereafter, the front sled subassembly 44 and the PCB 46, together with the remaining components, are assembled into the front and rear housings 42,52 completing the assembly of the jack 34.

Figure 9:
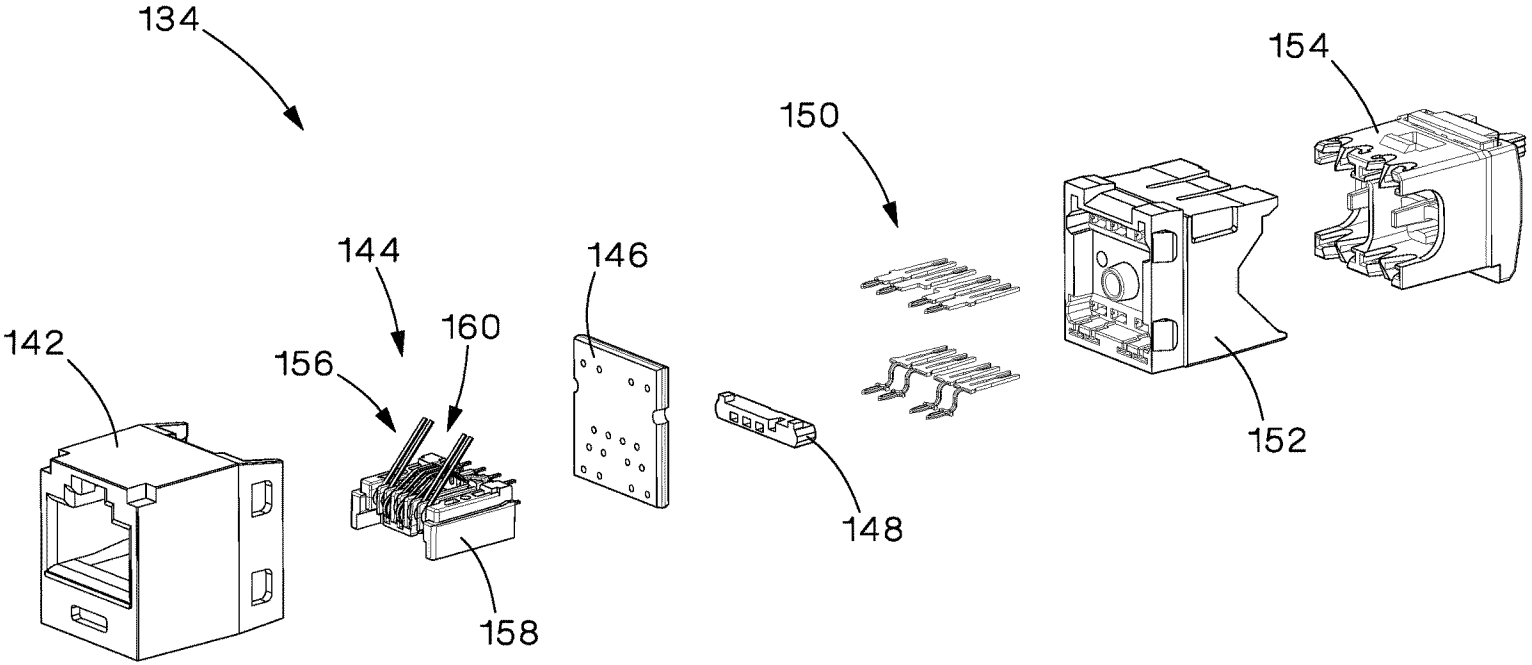
FIG. 9 illustrates an exploded view of a communication jack according to an embodiment of the present invention.

Another embodiment of a jack having a front sled subassembly in accordance with an embodiment of the present invention is shown in FIG. 9. This figure shows an exploded view of the network jack 134, which includes a front housing 142, a front sled subassembly 144, a PCB 146 (which in some embodiments may have crosstalk compensation components thereon), an IDC support 148, IDCs 150, a rear housing 152, and a wire cap 154. In the currently described embodiment, the front sled subassembly 144 includes a first set of PICs 156 and a second set of PICs 160, and a front sled 158 which can be made from any suitable material including, but not limited to, plastic. In alternate embodiments, jack 134 can additionally include alien crosstalk-reducing materials such as a foil.

Figure 10:
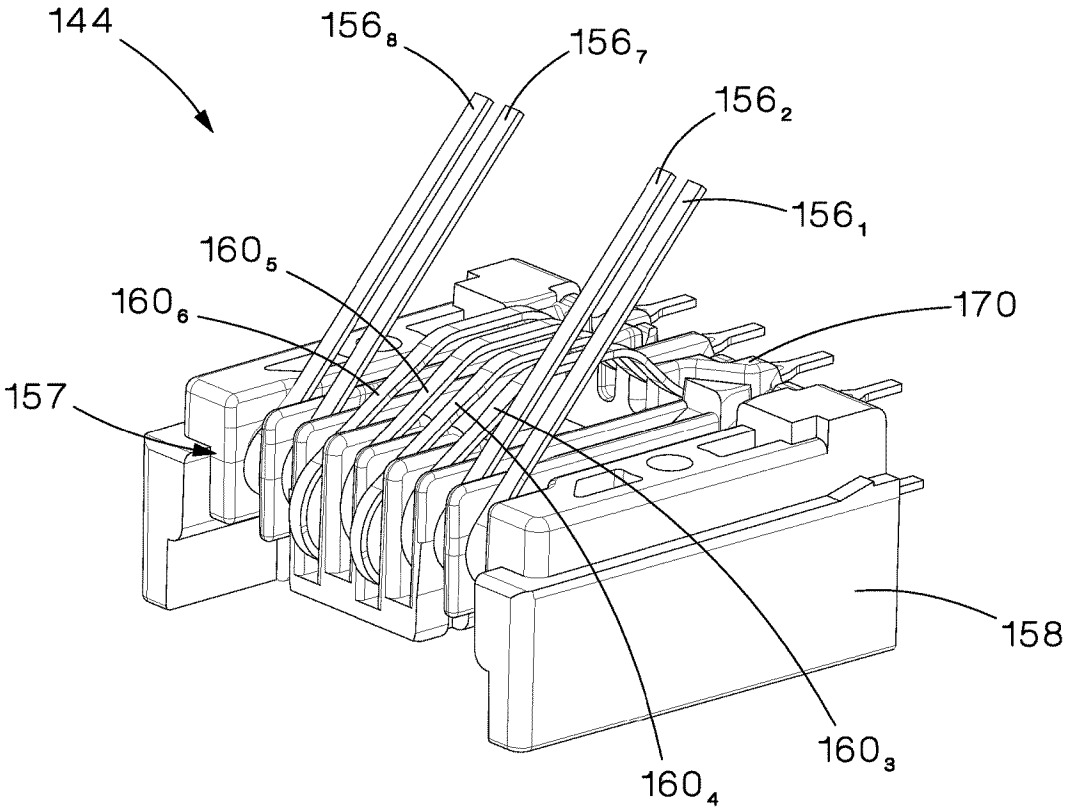
FIG. 10 illustrates a front perspective view of a front sled subassembly according to an embodiment of the present invention.
Figure 11:
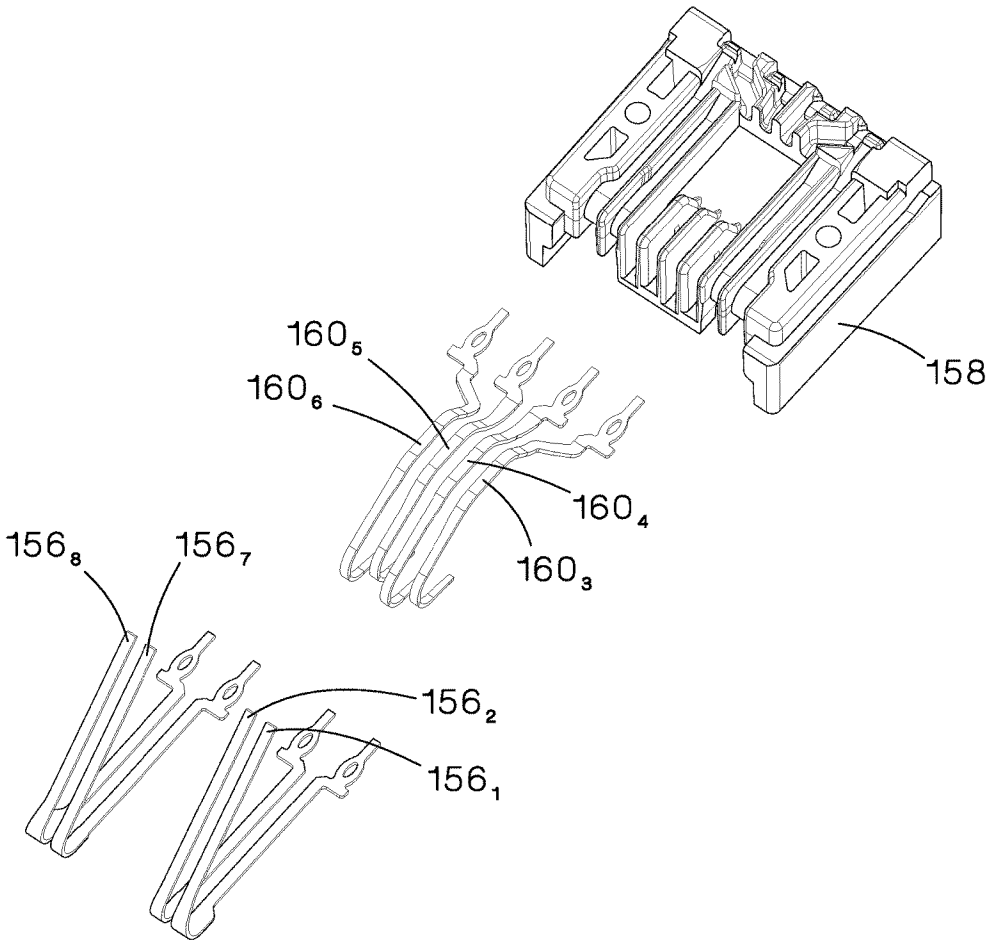
FIG. 11 illustrates an exploded view of the front sled subassembly of FIG. 10.

FIGS. 10 and 11 illustrate the front sled subassembly 144 with PICs 156,160 and the front sled 158 in greater detail. The subscript numbers for each PIC 156 and 160 correspond to the RJ45 pin positions as defined by ANSI/TIA-568-C.2.

As shown in FIG. 11, PICs 156 have a configuration that is similar to the PICs 56 of the previously described embodiment. Accordingly, PICs 156 are front-rotated PICs which generally flex about the front region 157 of the sled 158 when mated to a corresponding plug, and may exhibit features and/or benefits which are same/similar to the PICs 56.

Figure 12:
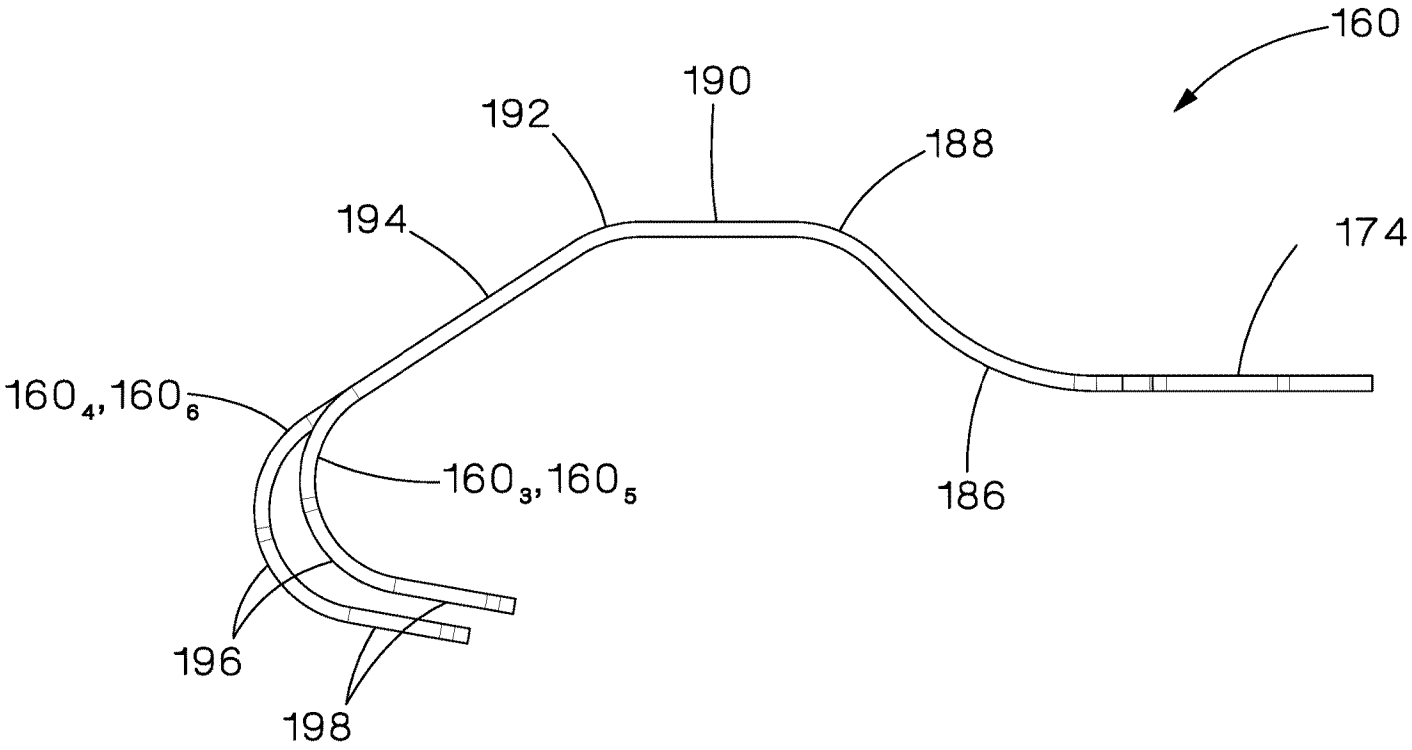
FIG. 12 illustrates side profiles of some of the plug interface contacts of the front sled subassembly of FIG. 10.

FIG. 12 illustrates a side profile for PICs 160. Note, that PICs 160 comprise two separate profiles; a longer profile for PICs $\mathbf{160}_4$ and $\mathbf{160}_6$, and a shorter profile for PICs $\mathbf{160}_3$ and $\mathbf{160}_5$. However, each PIC 160 includes a compliant pin 174, a first flex section 186, a second flex section 188, an upper beam portion 190, a first linking section 192 which links the upper beam portion 190 to a leg 194, and a second linking portion 196 (which in some embodiments may be referred to as a "C" shaped bend) which links the leg 194 to a free end 198.

The design of PICs 160 allows RJ45 pairs 4:5 and 3:6 to have a shorter electrical path from the plug contacts of the plug 36 to the PCB 146. The shortened distance may help to reduce or otherwise assist in reducing undesired crosstalk which can originate and/or occur on the 4:5 and 3:6 pairs.

Figure 13A:
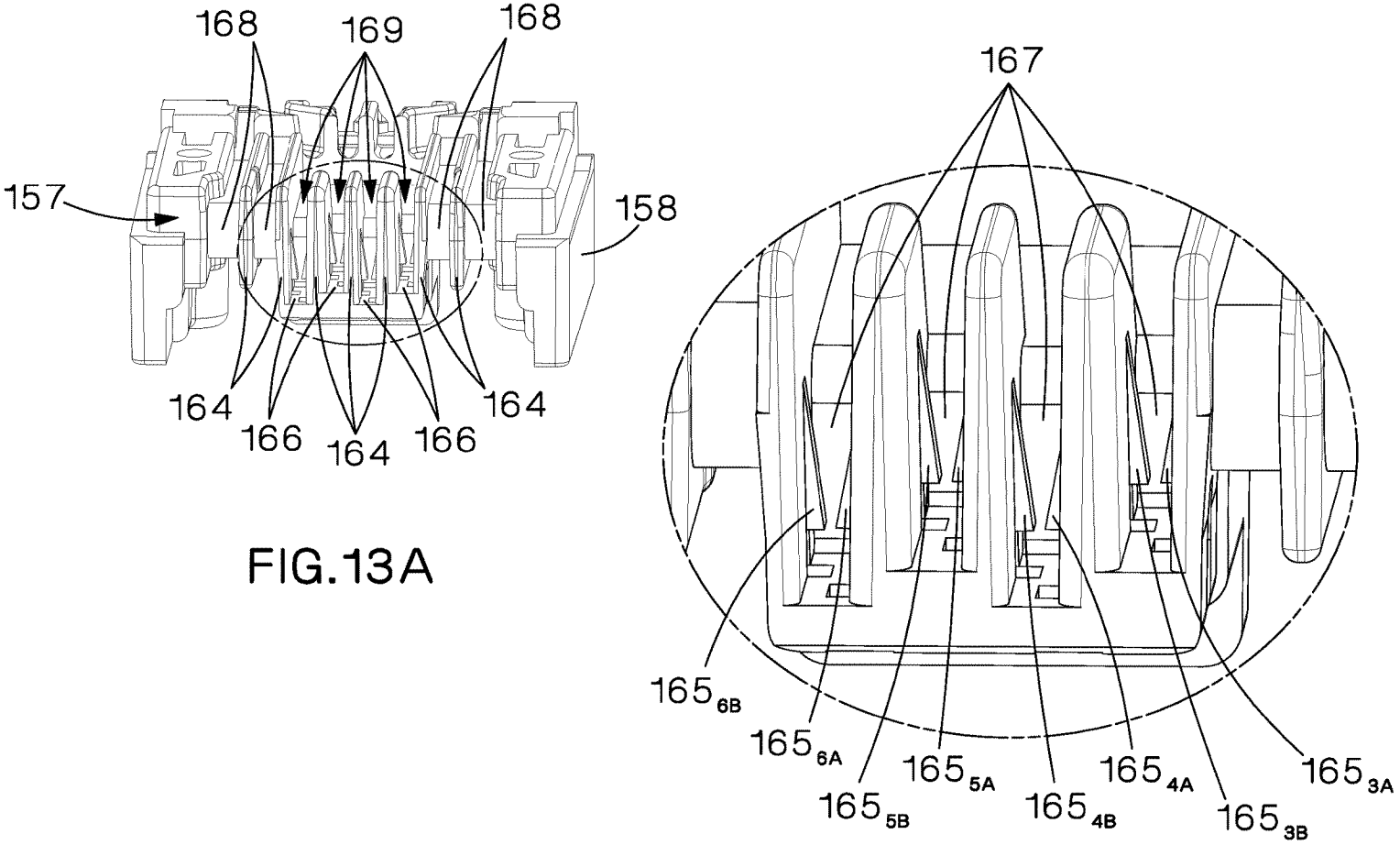
FIG. 13A illustrates a front perspective view of the front sled subassembly of FIG. 10 without the plug interface contacts installed.
Figure 13B:
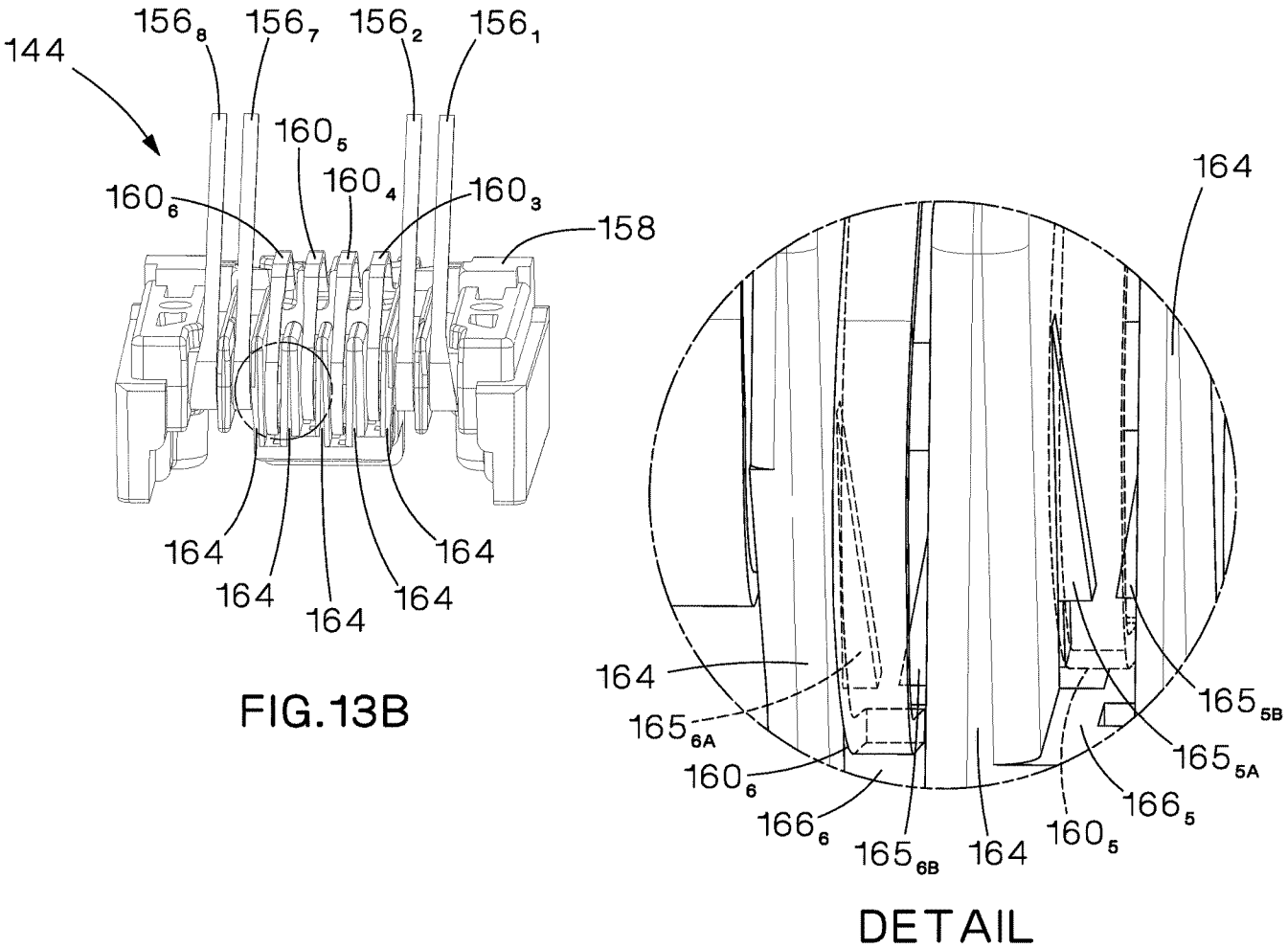
FIG. 13B illustrates a front perspective view of the front sled subassembly of FIG. 10 with the plug interface contacts installed.

FIG. 13A shows a front perspective view of the front sled 158. The front region 157 of the sled 158 includes mandrels 168 and a plurality of slots 169 which are at least partially separated by the front comb 164. The front comb 164 help separate and isolate each PIC from adjacent PICs, and slots 169 provide cavities which house portions of PICs $\mathbf{160}_3$, $\mathbf{160}_4$, $\mathbf{160}_5$, and $\mathbf{160}_6$. Slots 169 include floors 166, rear walls 167, and protrusion features 165 (which may also be referred to as latches). Each slot includes a pair of opposing latches $\mathbf{165}_{xA}$ and $\mathbf{165}_{xB}$ which are used to hold PICs 160 in close proximity to the floors 166. Latches $\mathbf{165}_{xA}$ are positioned ahead of latches $\mathbf{165}_{xB}$ so that each pair of corresponding latches is in a staggered formation. Such a configuration may help with PIC assembly, providing room for temporary, preferably non-plastic deformation of PICs 160 during their insertion into the front sled 158. The rear walls 167 may keep the PICs 160 from buckling inward during plug insertion by preventing the PICs 160 from moving in a backward direction. FIG. 13B illustrates the front sled 158 with the PICs 156,160 installed.

In the currently described embodiment, latches 165 are molded rigid protrusions. However, other embodiments may implement latches 165 as soft, pliable, elastomeric, and/or moveable features which accomplish the task of providing at least some restraint of PICs 160 within their respective slots. Furthermore, while the currently described embodiment illustrates each slot 169 having two latches $\mathbf{165}_{xA}$,$\mathbf{165}_{xB}$, this configuration is merely exemplary and any slot 169 may include any desired number of latches.

Figure 14:
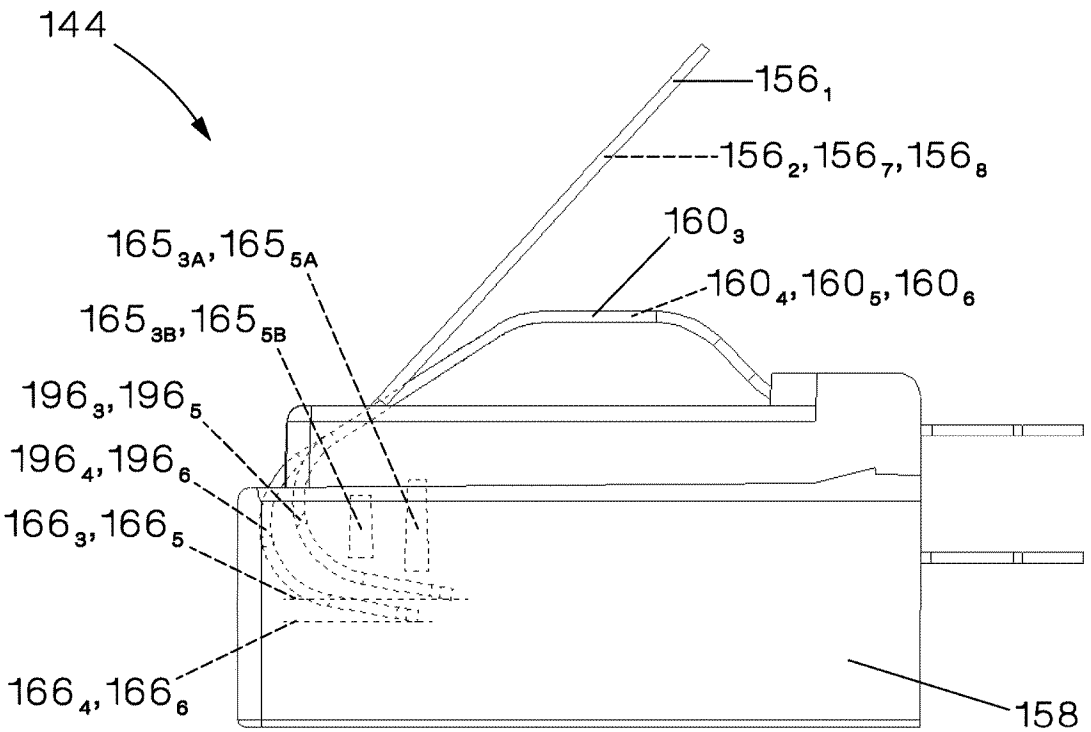
FIG. 14 illustrates a side profile view of the front sled subassembly of FIG. 10.
Figure 15:
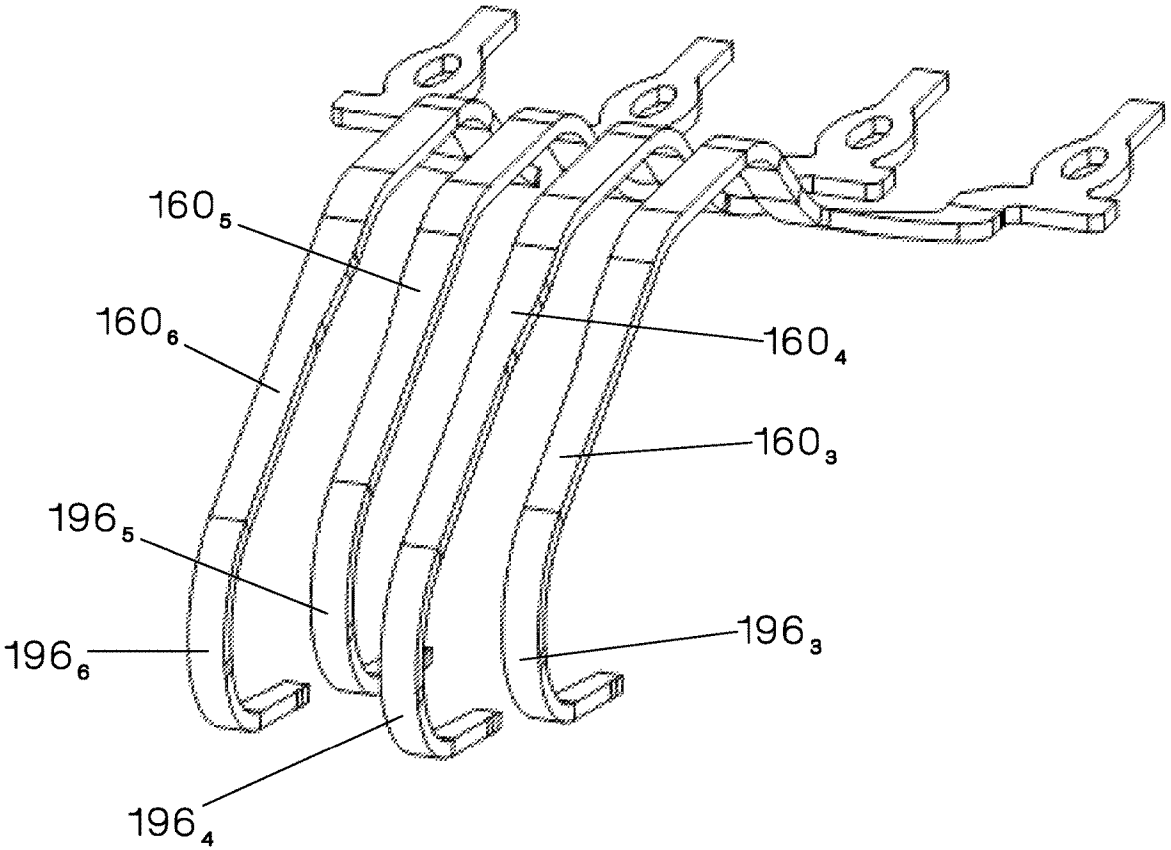
FIG. 15 illustrates some of the plug interface contacts of the front sled subassembly of FIG. 10.

As shown in the side views of FIGS. 12 and 14, PICs 160 have a second linking portion 196 which can act as a spring when PICs 160 are deflected by the plug contacts of plug 36. The second linking portions 196 may help provide sufficient normal force and a robust interface between PICs 160 and the plug contacts of plug 36 over the full range of plug contact locations. PICs 160 are supported at their free ends 198 by floors 166. To reduce the relative amount of capacitive crosstalk coupling among PICs 160, physical staggering of the PICs 160 exists in the region of the second linking portions 196 and the free ends 198. In the current embodiment, the staggered configuration is achieved by having the profiles of the second linking portions $\mathbf{196}_3$,$\mathbf{196}_5$ of PICs $\mathbf{160}_3$,$\mathbf{160}_5$ differ from the profiles of the second linking portions $\mathbf{196}_4$,$\mathbf{196}_6$ of PICs $\mathbf{160}_4$,$\mathbf{160}_6$. The staggered configuration increases space between the crosstalk-causing PICs 160 thereby decreasing the amount of crosstalk coupling. The staggering of PICs 160 is also shown isometrically in FIG. 15.

Figure 16:
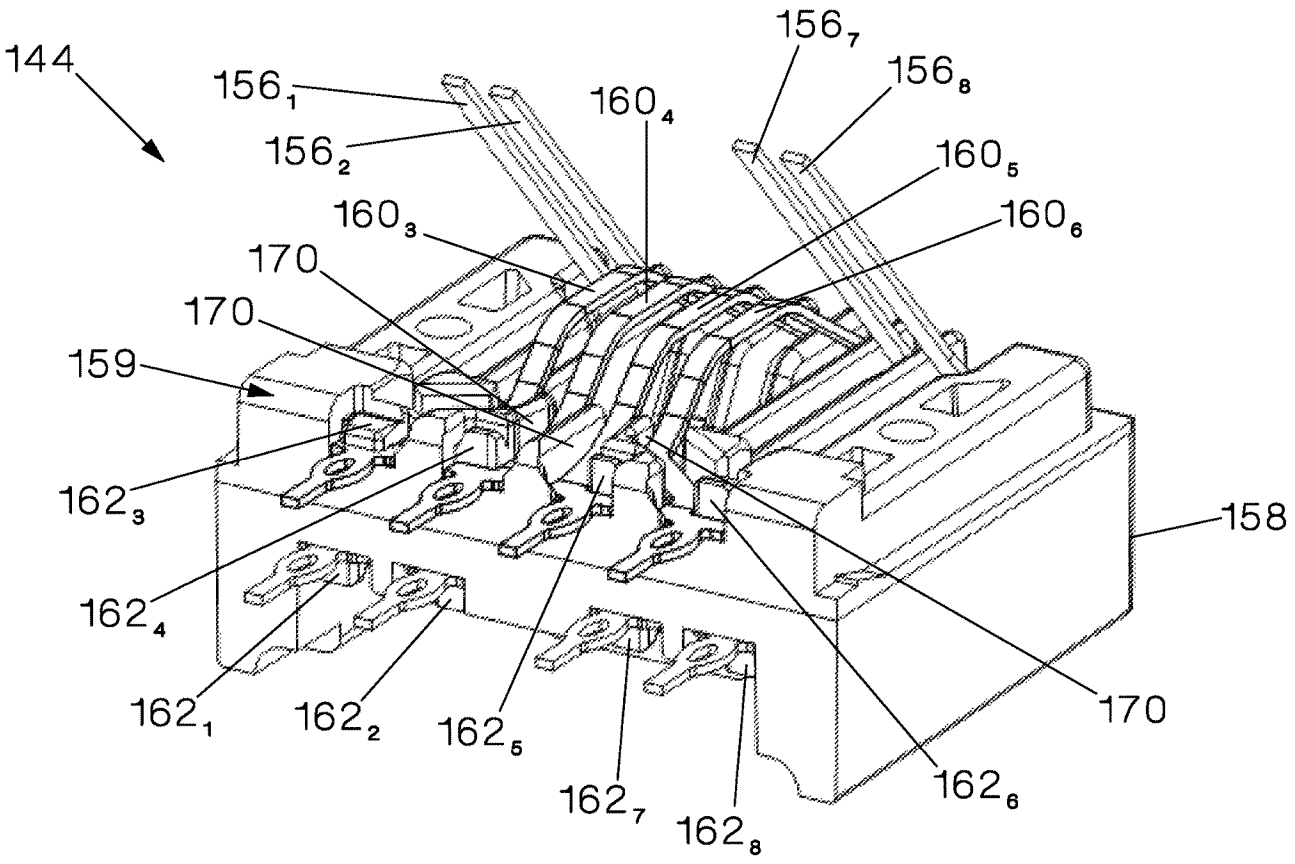
FIG. 16 illustrates a rear perspective view of the front sled subassembly of FIG. 10.

FIG. 16 shows a rear isometric view of front sled subassembly 144. Rear comb 170 is a feature of the front sled 158 and separates each PIC 160 from adjacent PICs 160 in the rear section 159 of the sled. PICs 156 and 160 are affixed to the sled 158 by securing features 162. In some embodiments, securing features 162 may be staking features. Note that in FIG. 16 all securing features 162 are illustrated as staking features. However, with the exception of securing feature 1623, all other securing features 162 are shown in their "as molded" state. Only 1623 is shown staked as it would be after assembly. Accordingly, in an embodiment where the securing features 162 are staking features, all securing features 162 may resemble securing feature 1623 in the final assembled state of the front sled subassembly 144.

To assemble the front sled subassembly 144, PICs 156 and 160 are joined to the front sled 158. PICs 156 are joined in a manner that is same/similar to the joining of the PICs 56 to the front sled 58 of the previously described embodiment. As for PICs 160, the curvature of their second linking portions 196 must be at least partially formed prior to mating with the front sled 158 to ensure that the free ends 198 are properly positioned between the latches 165 and the floors 166. When the second linking portions 196 are formed such that the free ends 198 can be properly positioned, PICs 160 are joined to the front sled 158 allowing the free ends 198 to descend into the slots 169 and lock into position via latches 165. PICs 160 are further secured by the securing features 162 near the rear section 159 of the front sled 158. After the front sled subassembly 144 has been assembled, it can then be attached to a PCB 146 and thereafter installed into the jack 134 as previously described.

Figure 17:
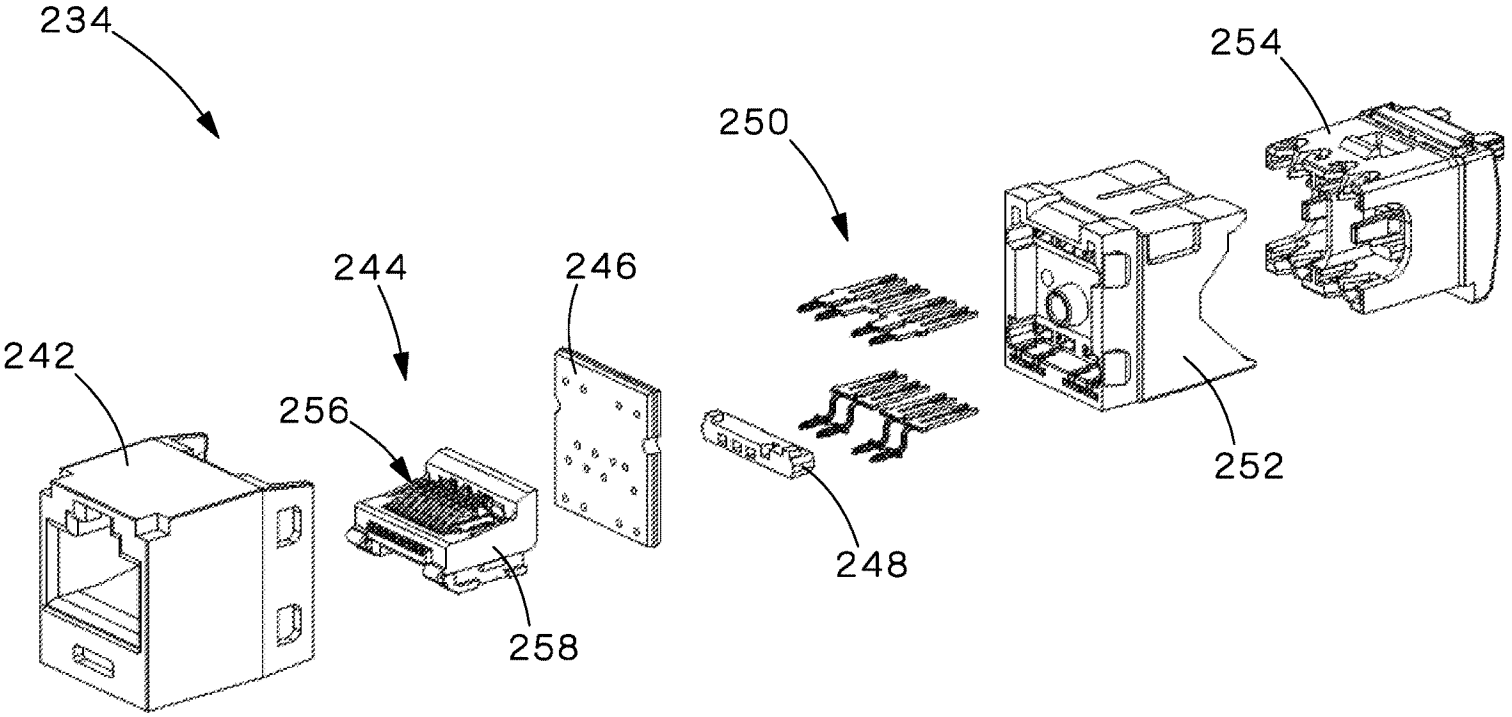
FIG. 17 illustrates an exploded view of a communication jack according to an embodiment of the present invention.
Figure 18A:
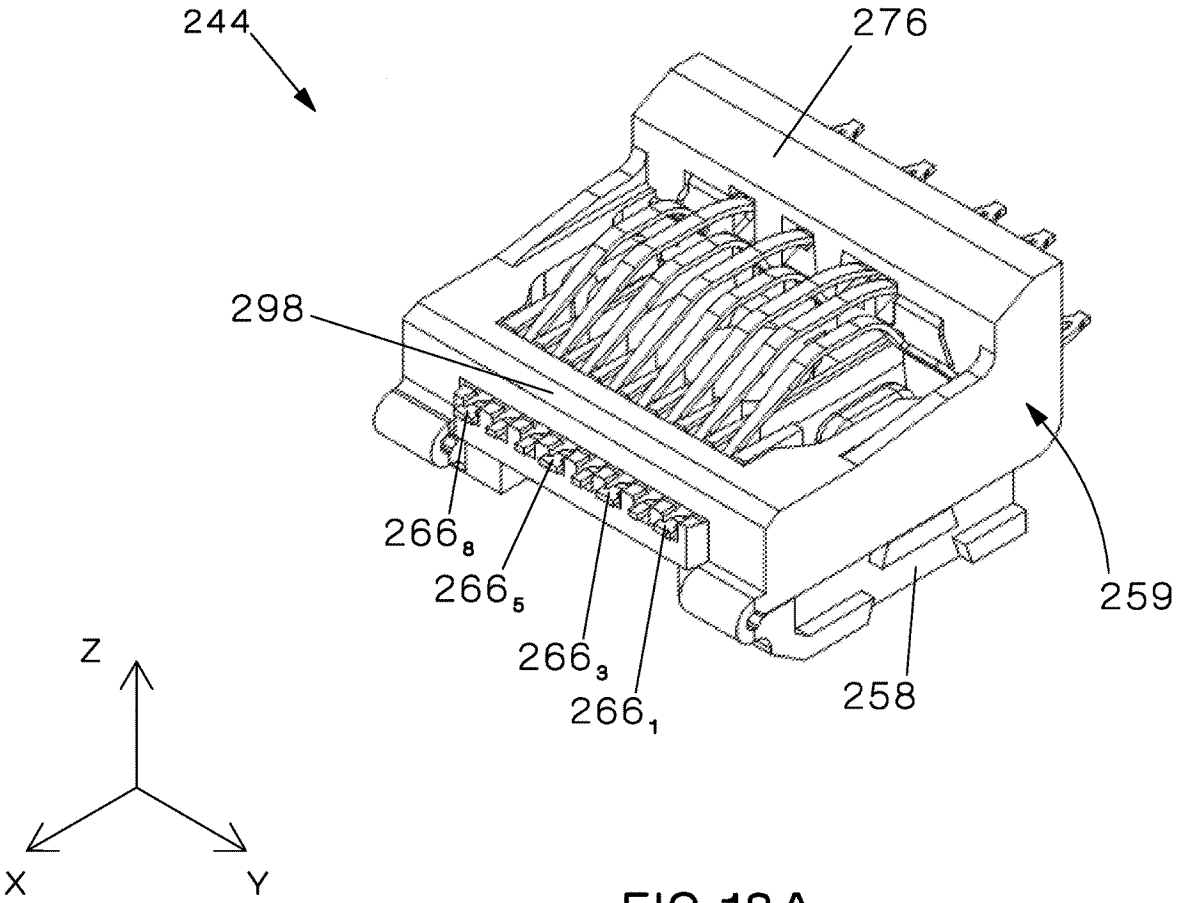
FIG. 18A illustrates a front perspective view of a front sled subassembly according to an embodiment of the present invention.
Figure 18B:
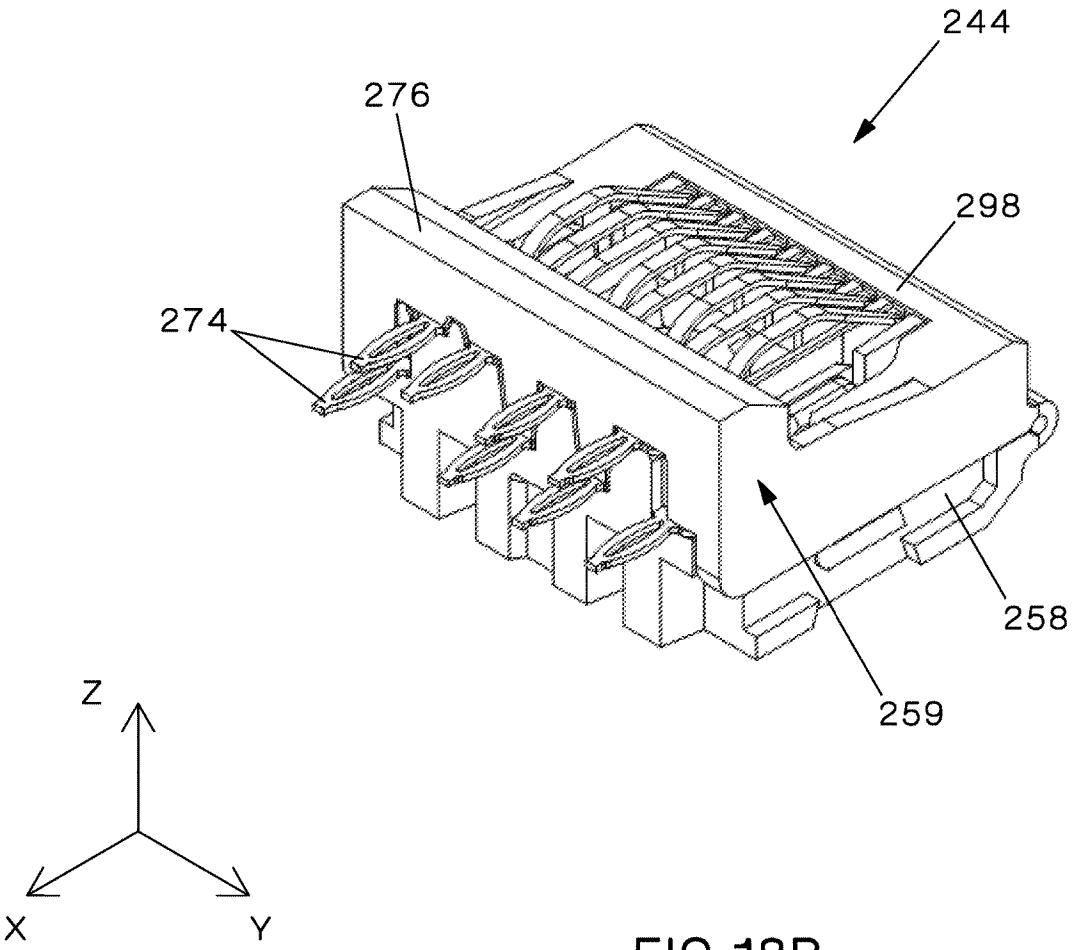
FIG. 18B illustrates a rear perspective view of the front sled subassembly of FIG. 18A.

Yet another embodiment of a jack having a front sled subassembly in accordance with an embodiment of the present invention is shown in FIG. 17. This figure shows an exploded view of a jack 234, which includes a front housing 242, a front sled subassembly 244, a PCB 246 (which in some embodiments may have crosstalk compensation components thereon), an IDC support 248, IDCs 250, a rear housing 252, and a wire cap 254. Alien crosstalk-reducing materials may be used in the construction of jack 234.

FIGS. 18A-20 illustrate the front sled subassembly 244 with PICs 256 and the front sled 258 in greater detail. The subscript numbers for each PIC 256 correspond to the RJ45 pin positions as defined by ANSI/TIA-568-C.2. The PICs 256 may be referred to as "back-rotated" as these PICs generally flex in the rear section 259 of the sled 258.

Figure 19:
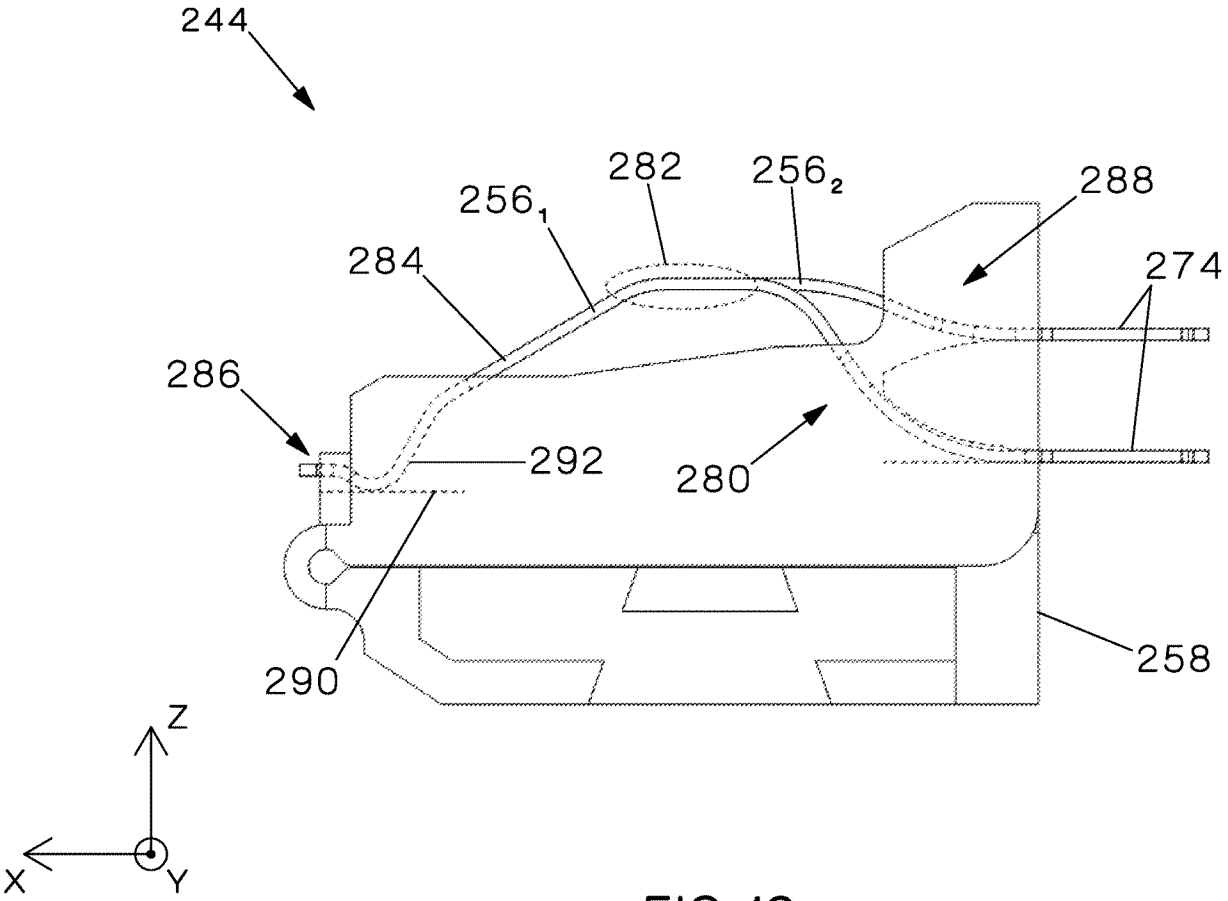
FIG. 19 illustrates a side profile view of the front sled subassembly of FIG. 18A.

FIG. 19 shows a side profile view for the front sled subassembly 244, illustrating that the subassembly includes PICs having two separate side profiles. PIC $\mathbf{256}_1$ has a side profile representative of PICs $\mathbf{256}_4$, $\mathbf{256}_6$, and $\mathbf{256}_8$, and includes a compliant pin 274, a flex section 280, a plug contact zone 282, a leg 284, and a free end 286. PIC $\mathbf{256}_2$ has a side profile representative of PICs $\mathbf{256}_3$, $\mathbf{256}_5$, and $\mathbf{256}_7$, and includes a compliant pin 274, a flexing section 288, a plug contact zone 282, a leg 284, and a free end 286. The free ends 286 are supported along the floor 290 located at the front region of the sled 258.

Figure 20:
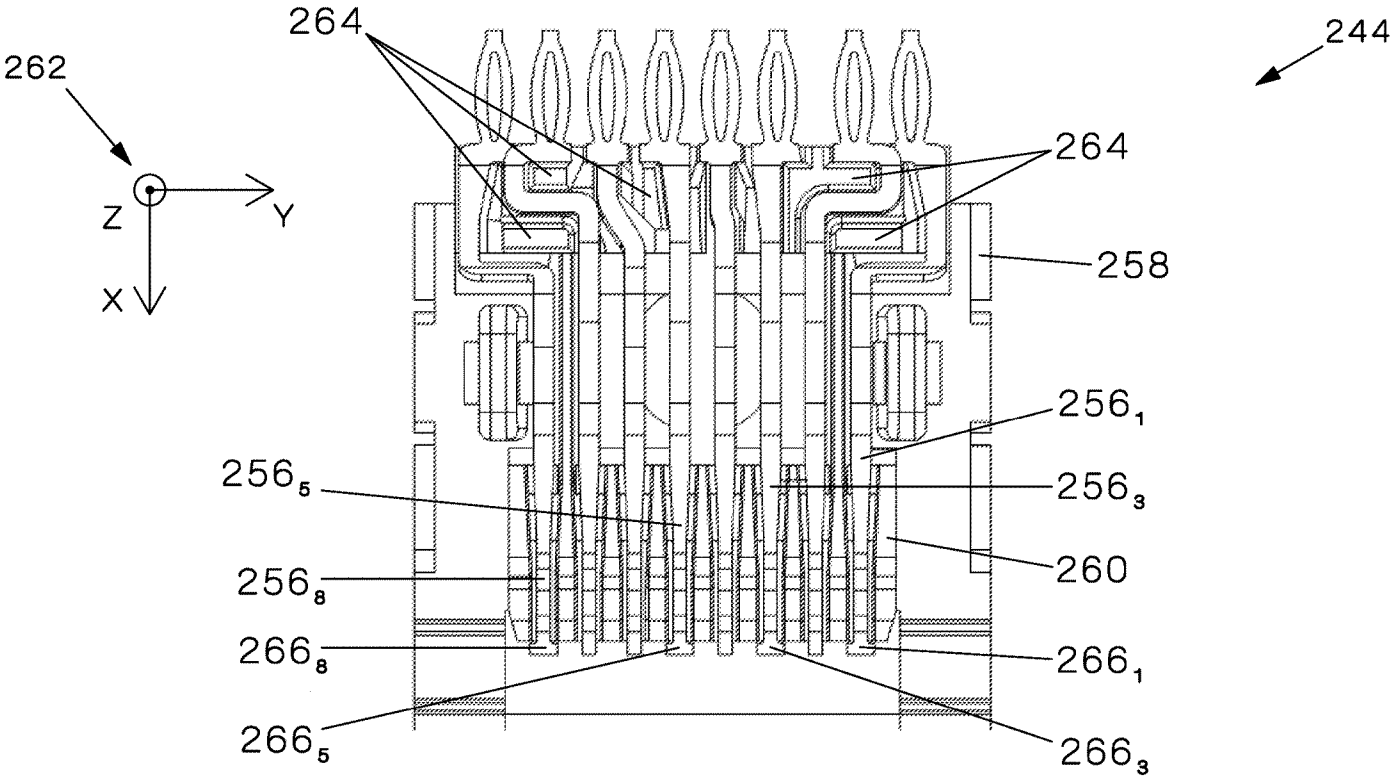
FIG. 20 illustrates a fragmentary top view of the front sled subassembly of FIG. 18A.
Figure 21:
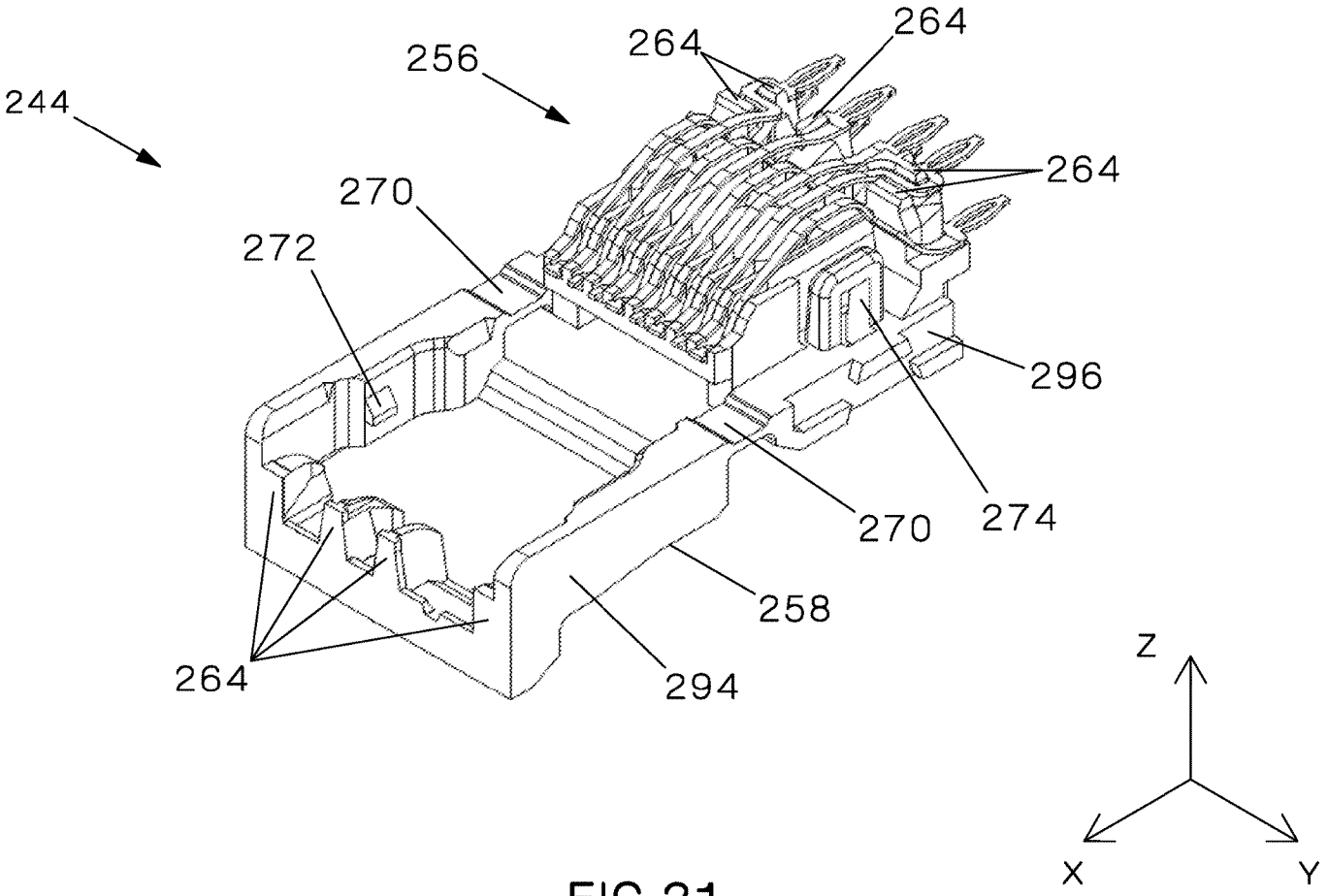
FIG. 21 illustrates a front perspective view of the front sled subassembly of FIG. 18A in an open state.

FIG. 20 shows a top view of the front sled subassembly 244 illustrating additional features which may be present in the currently described embodiment. In particular, the sled 258 includes features to hold the PICs 256 in position, and reduce and/or eliminate unwanted degrees of freedom. The sled 258 includes a front comb 260 which serves to align respective PICs 256 in they direction with respect to the coordinate legend 262. Rear combs 264 (also present on the top portion 294 of the sled 258 as shown in FIG. 21) at least partially constrain PICs 256 in the x and/or y directions. Since PICs $\mathbf{256}_3$ and $\mathbf{256}_5$ still retain a degree of freedom in the −x direction, these PICs include "T" features $\mathbf{266}_3$ and $\mathbf{266}_5$, respectively, positioned at the free ends 286 thereof. The "T" features $\mathbf{266}_3$ and $\mathbf{266}_5$ at least partially prevent PICs $\mathbf{256}_3$ and $\mathbf{256}_5$ from moving in the −x direction and into the comb 260. "T" features $\mathbf{266}_1$ and $\mathbf{266}_8$ also exist on PICs $\mathbf{256}_1$ and $\mathbf{256}_8$, respectively, to help ensure that these PICs do not buckle in the −x direction when a six-position plug is inserted, and instead deflect down in a −z direction. Same or similar "T" features can also be implemented on PICs $\mathbf{256}_2$ and $\mathbf{256}_7$ to help the jack 234 have compatibility with a four-position plug.

Referring back to FIG. 19, PICs 256 deflect in the −z direction when they make contact with the plug contacts of an RJ45 plug in the plug contact zone 282 (or with the housing of a plug in case of PICs $\mathbf{256}_1$ and $\mathbf{256}_8$ when a six-position plug is used). As the PICs 256 deflect in the −z direction in the contact zone 282 during the mating of a plug, the free ends 286 of PICs 256 slide in the +x direction. The free end 286 can include a curved contact section 292 for making contact with the floor 290. Such a configuration may improve the physical performance of the jack 234 by allowing the free ends 286 to more-easily slide along the x direction. Furthermore, the support of the free ends 286 by the floor 290 can increase the normal force at the interface between the PICs 256 and the plug contacts of an RJ45 plug. This may be beneficial in ensuring a satisfactory electrical contact.

Referring to FIG. 21, the front sled subassembly 244 includes a two-piece sled 258 which has a top portion 294 and a bottom portion 296. When joined together, the top and bottom portions 294,296 help constrain PICs 256 in their respective positions. In the currently described embodiment, the top portion 294 and the bottom portion 296 are hingedly attached to one another via hinging features 270, and lock in a closed position via latches 272 and latch pockets 274. However, alternate embodiment may omit the hinging feature 270 and instead provide the top and bottom portions 294,296 as separate pieces. Likewise, the locking of the two portions may be achieved by any other suitable means which may or may not rely on the latches 272 and latch pockets 274. In yet another embodiment, the front sled 258 may be provided as one piece where the top and bottom portions are joined together by a bridge which is broken at the time of assembly.

Figure 22:
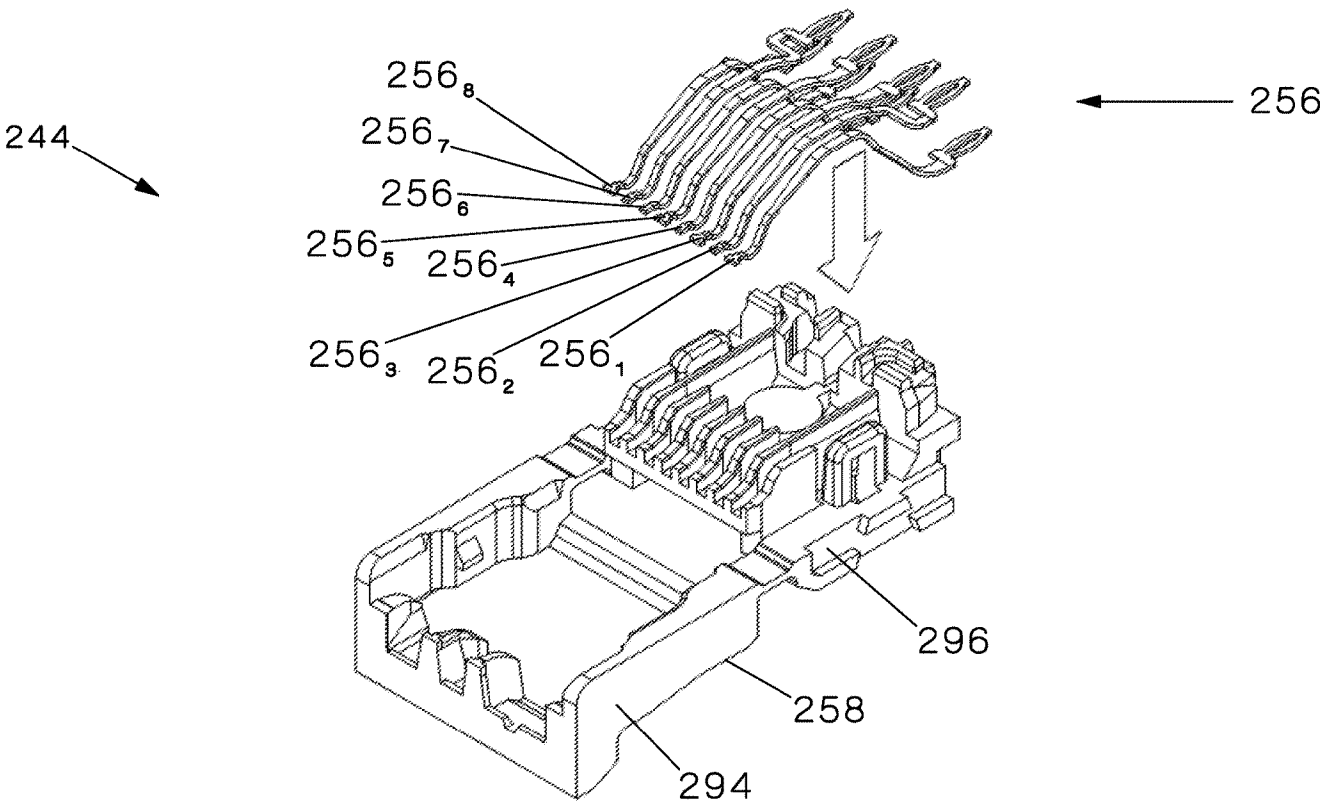
FIG. 22 illustrates a step in the assembly process of the front sled subassembly of FIG. 18A.
Figure 23:
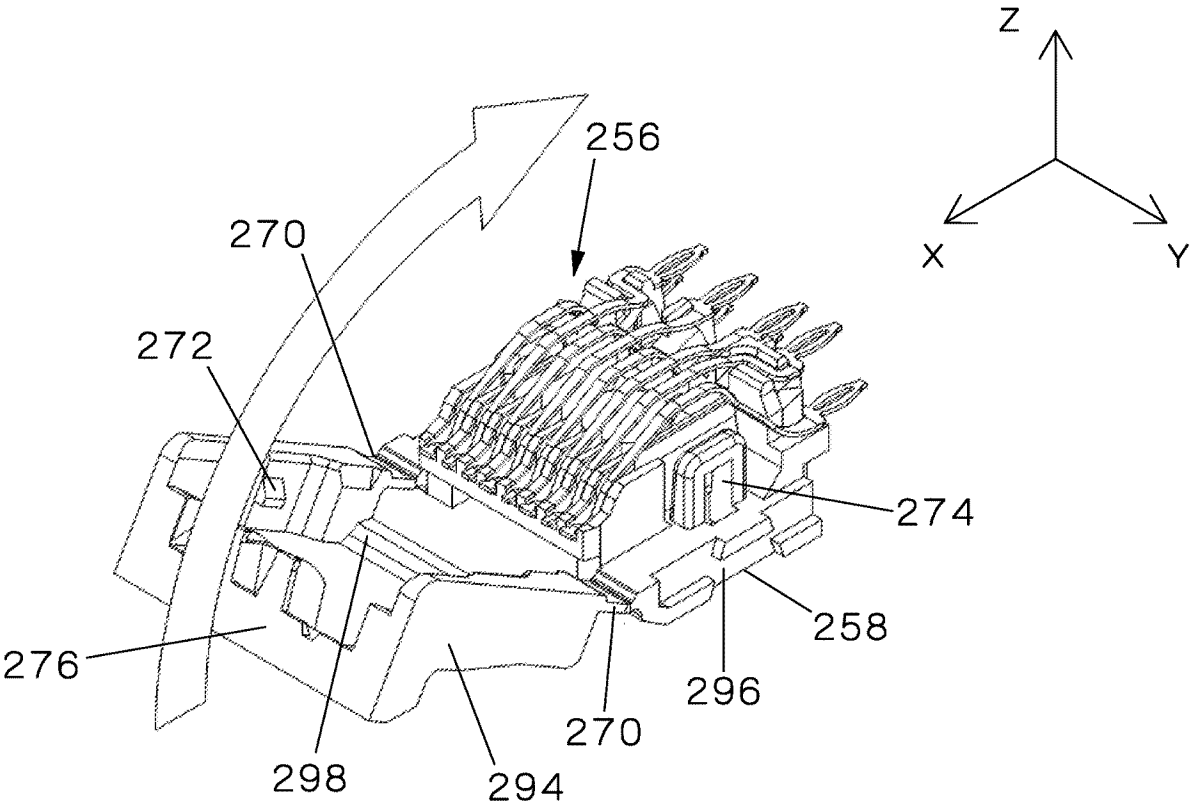
FIG. 23 illustrates another step in the assembly process of the front sled subassembly of FIG. 18A.
Figure 24:
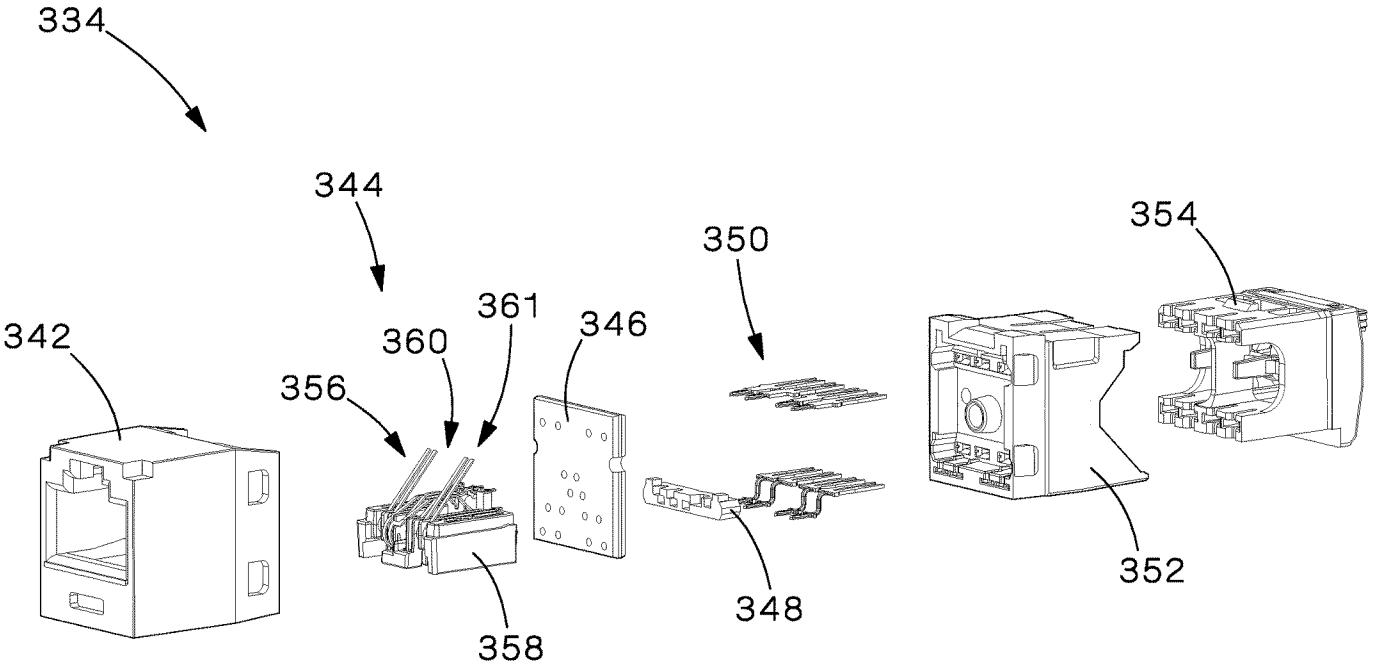
FIG. 24 illustrates an exploded view of a communication jack according to an embodiment of the present invention.

FIGS. 22 and 23 illustrate the assembly of the front sled subassembly 244. The front sled subassembly 244 is fabricated by first lowering the PICs 256 onto the bottom portion 296 of the sled 258. When the all the PICs 256 are positioned in their respective locations, the top portion 294 of the sled 258 is rotated about the hinging features 270, as shown by the arrow in FIG. 23, until it rotates approximately 180° from its original open position and latches 272 engage the latch pockets 274, completing the assembly of the front sled subassembly 244. The engaging of the latches 272 and the latch pockets 274 locks the top and bottom portions 294,296, constraining the PICs and reducing and/or eliminating their undesired degrees of freedom. The constraining of the PICs is achieved at least partially by the bridge 276 (also see FIGS. 18A and 18B) which secures the PICs 256 in the region near the compliant pins 274 and restrains their movement in the z direction in that region, and the front bridge 298 which restrains the movement of the PICs in the z direction near the front portion of the sled 258. After the front sled subassembly 244 has been assembled, it can then be attached to a PCB 246 and thereafter installed into the jack 234 as previously described.

In another embodiment according to the present invention (FIGS. 24-34) network jack 334 includes front housing 342, front sled subassembly 344, PCB 346, IDC support 348, IDCs 350, rear housing 352, and wire cap 354. Front sled subassembly 344 includes PICs 356, 360, 361, and a plastic sled 358. Jack 334, and other jacks described herein, can additionally include an alien crosstalk reducing foil as described in U.S. Pat. No. 8,362,632 (Straka et al.) entitled "Method and system for improving crosstalk attenuation within a plug/jack connection and between nearby plug/jack combinations", incorporated by reference as if fully set forth herein.

Figure 25:
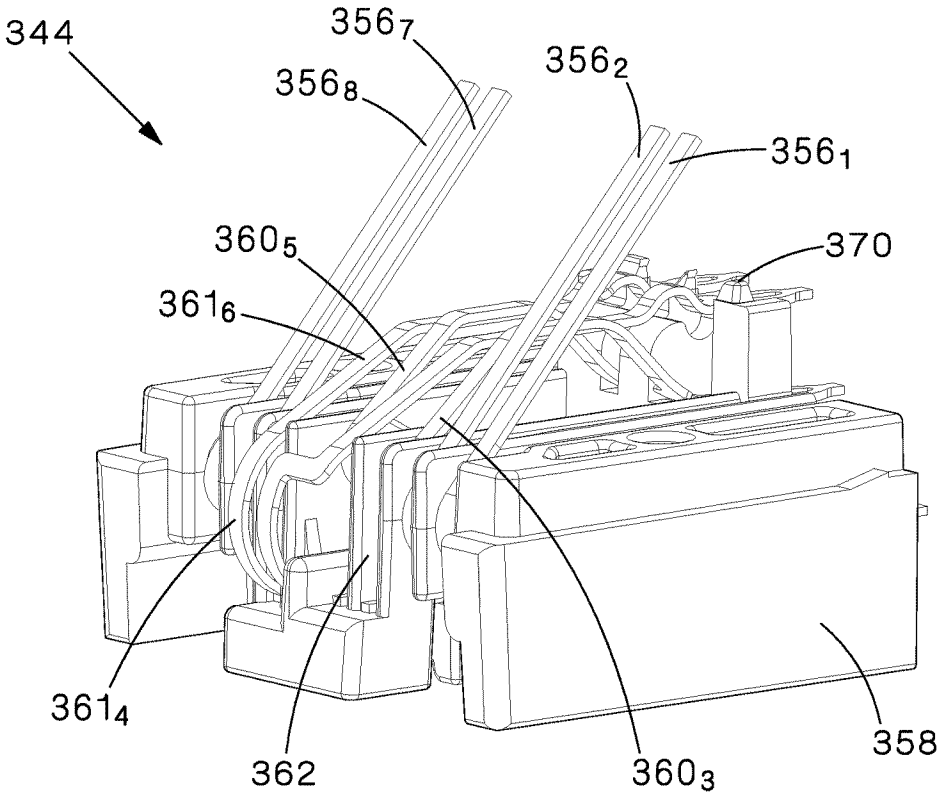
FIG. 25 illustrates a front perspective view of a front sled subassembly according to an embodiment of the present invention.

FIG. 25 illustrates front sled subassembly 344 with PICs 356, 360, 361, and sled 358. The subscript numbers of each PIC 356, 360, and 361 represent RJ45 pin positions as defined by ANSI/TIA-568-C.2.

Figure 26:
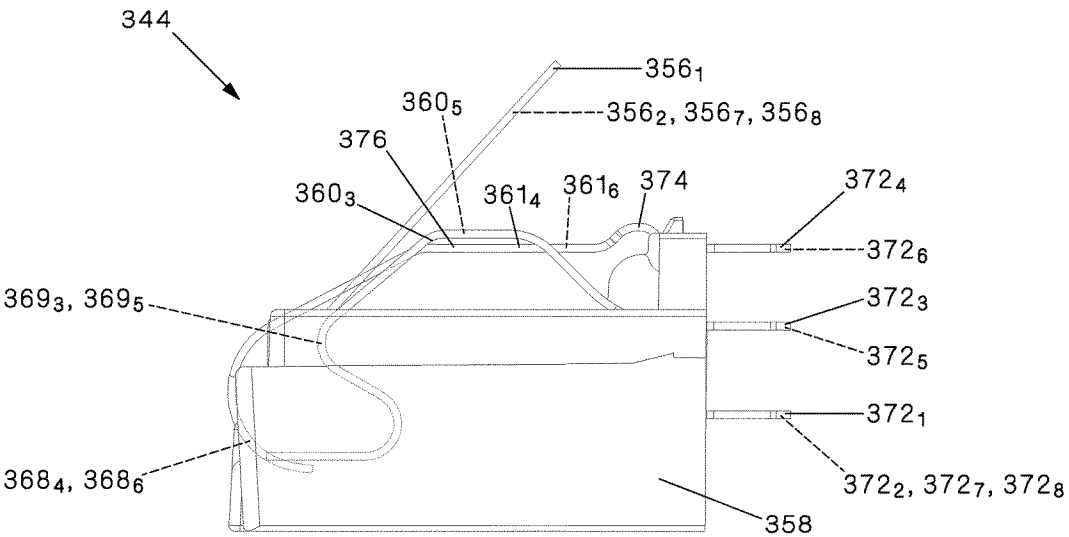
FIG. 26 illustrates a side view of the front sled subassembly of FIG. 25.
Figure 27:
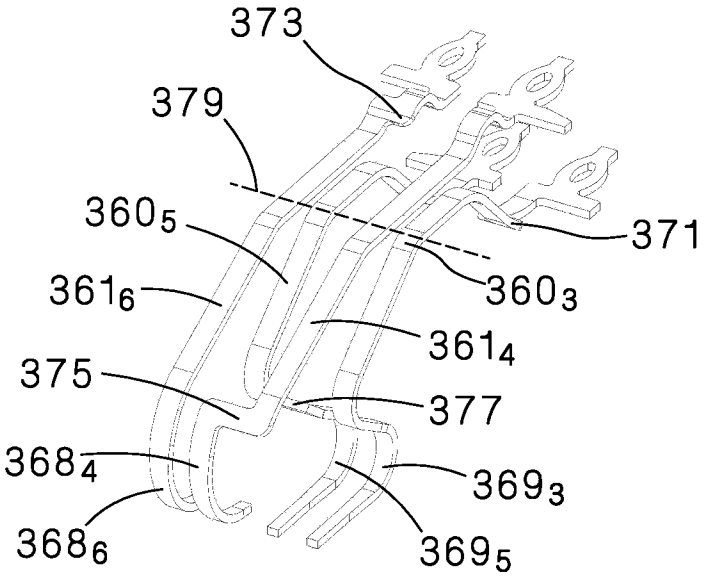
FIG. 27 illustrates a perspective view of an embodiment of plug interface contacts 4-6 of the front sled subassembly of FIG. 25.

A side view of front sled subassembly 344 is shown in FIG. 26. The staggering of PICs 360 and 361 is also shown isometrically in FIG. 27. PICs 361 have a front "C" shaped bend 368 that acts as a spring when PICs 361 are deflected by the contacts of plug 36. The "C" shaped bend 368 helps provide sufficient normal force and a robust interface between PICs 361 and the contacts of plug 36 over the full range of plug contact locations. PICs 361 are supported at their free end by floors of plastic sled 358. In order to further reduce capacitive and inductive crosstalk between these pairs in the present front sled assembly 344, PICs 360 have a front "S" shaped bend 369 that also acts as a spring when PICs 361 are deflected by contacts of plug 36, but an "S" shaped bend 369 provides further separation from crosstalk pairs. In order to increase compensation between pairs 3:5 and 4:6, PIC 3603 includes jog 371 which decreases the physical distance between pairs 3:5 after the point of electrical contact 379 between the plug contacts of RJ45 plug 36 and PICs 356, 360, and 361. This feature may improve both capacitive and inductive compensation. PIC $\mathbf{361}_6$ includes jog 373 which decreases the physical distance between pairs 4:6 after the point of electrical contact 379. This feature may also improve both capacitive and inductive compensation. PIC $\mathbf{361}_4$ includes jog 375 which decreases the physical distance between pairs 4:6 past the point of electrical contact 379. This feature may improve capacitive compensation. PIC $\mathbf{360}_5$ includes jog 377 which decreases the physical distance between pairs 3:5 past the point of electrical contact 379. This feature may improve capacitive compensation. Jogs 375 and 377 result in a physical crossover of PICs $\mathbf{361}_4$ and $\mathbf{360}_5$, prior to the point of electrical contact 379. This crossover of pairs provides a reduced distance between compensation pairs.

Front sled assembly 344 staggers the compliant pins 372 of the PICs 356, 360, 361 onto three different planes as shown in FIG. 26. This allows for further separation of crosstalk pairs by placing complaint pins $\mathbf{372}_4$ and $\mathbf{372}_6$ on the highest plane, complaint pins $\mathbf{372}_3$ and $\mathbf{372}_5$ on the middle plane, and complaint pins $\mathbf{372}_1$, $\mathbf{372}_2$, $\mathbf{372}_7$, and $\mathbf{372}_8$ on the lowest plane. It is understood by those skilled in the art, that having the same electrical length of PICs 360 and 361 improves electrical balance in front sled subassembly 344. In order to make all PICs with approximately the same electrical length, bend 374 has been added to PICs $\mathbf{361}_4$ and $\mathbf{361}_6$ to accommodate for the added electrical length needed to drop compliant pins $\mathbf{372}_3$ and $\mathbf{372}_5$ to the middle layer and to improve mechanical strength. PIC's 360 and 361 also have a varied initial plug contact height which can be seen in stagger 376. Stagger 376 changes the angle of deflection during electrical contact which minimizes crosstalk by increasing spacing between crosstalk pairs.

Figure 28:
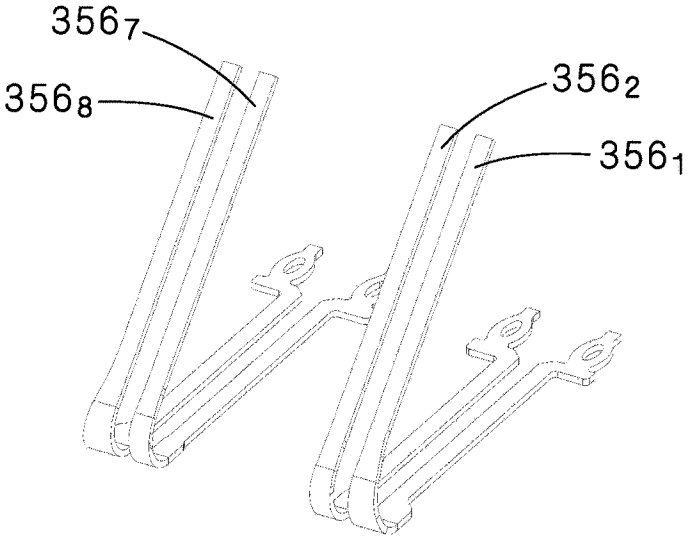
FIG. 28 illustrates a perspective view of an embodiment of plug interface contacts 1, 2, 7, 8 of the front sled subassembly of FIG. 25.

An isometric view of front rotated PICs 356 of the present invention can be seen in FIG. 28.

Figure 29:
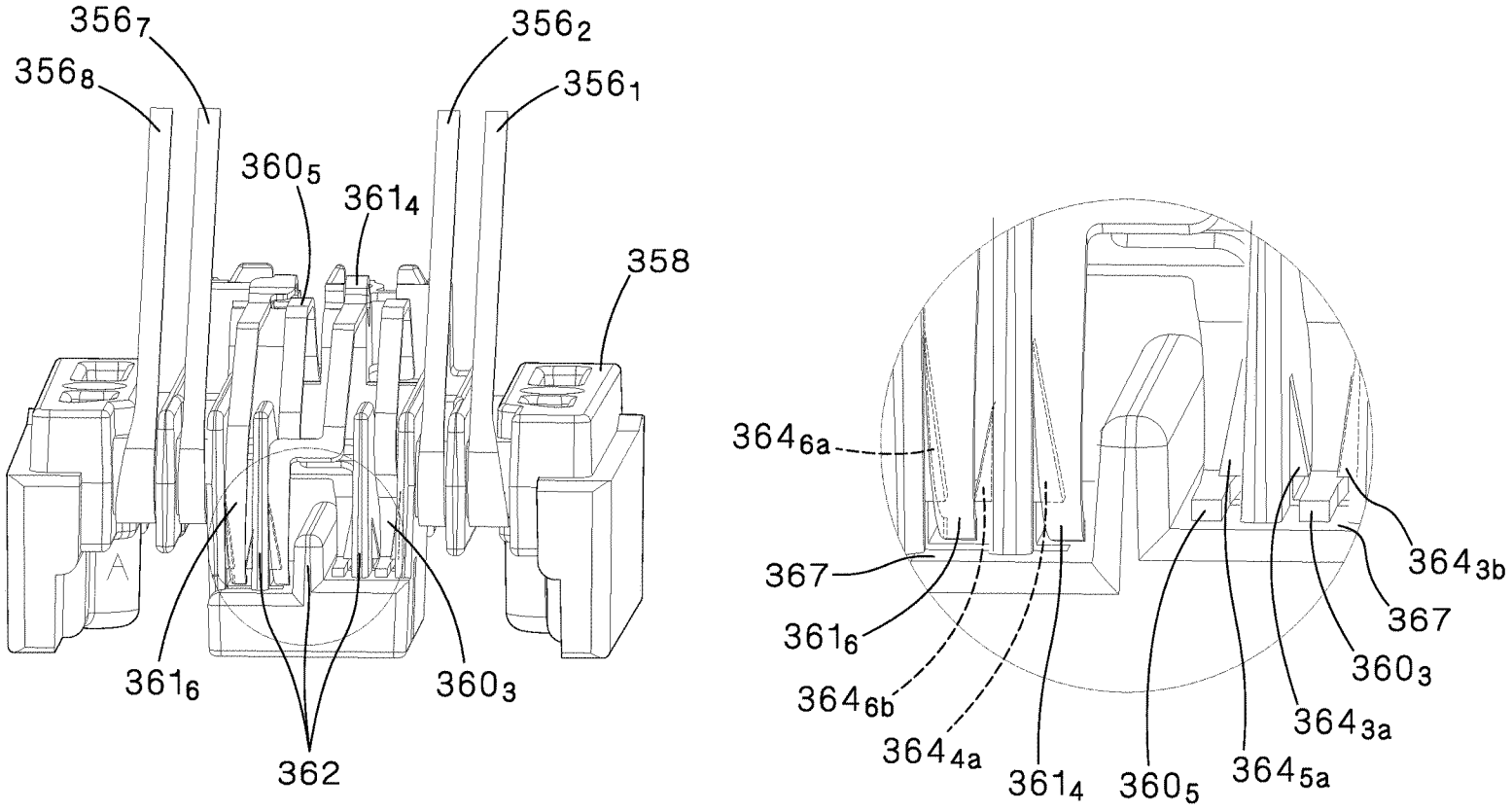
FIG. 29 illustrates a front perspective view of the front sled subassembly of FIG. 25.

FIG. 29 is a front isometric view of front sled subassembly 344. PICs 360 and 361 are positioned between front combs 362 and are retained by latches 364 (at least one latch 364 per each PIC 360,361, one indicated by subscript "a" and the other latch indicated by subscript "b"), shown in the detail view of FIG. 29. Latches 364 are used to hold PICs 360,361 in close proximity to floors 367 of front sled 358 so that PICs 360 are protected within front combs 362 and do not become damaged during assembly handling, for example bowl feeding.

Figure 30:
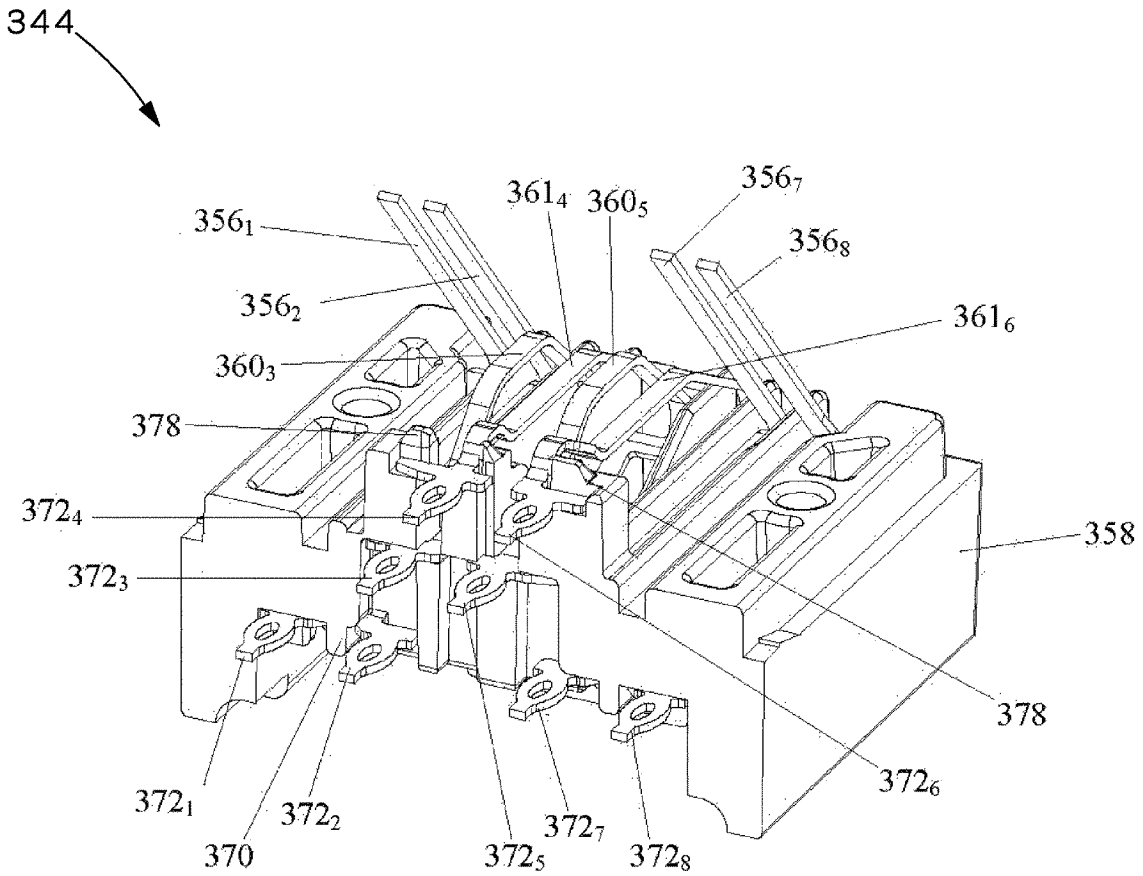
FIG. 30 illustrates a rear perspective view of the front sled subassembly of FIG. 25.

FIG. 30 is a rear isometric view of front sled subassembly 344. Rear combs 370 are features of plastic sled 358 and separate each PIC 356, 360, and 361 from adjacent PICs. PICs 360 and 361 are affixed to plastic sled 358 by staking features 378. FIG. 30 also illustrates the three different levels of compliant pins 372.

Figure 31:
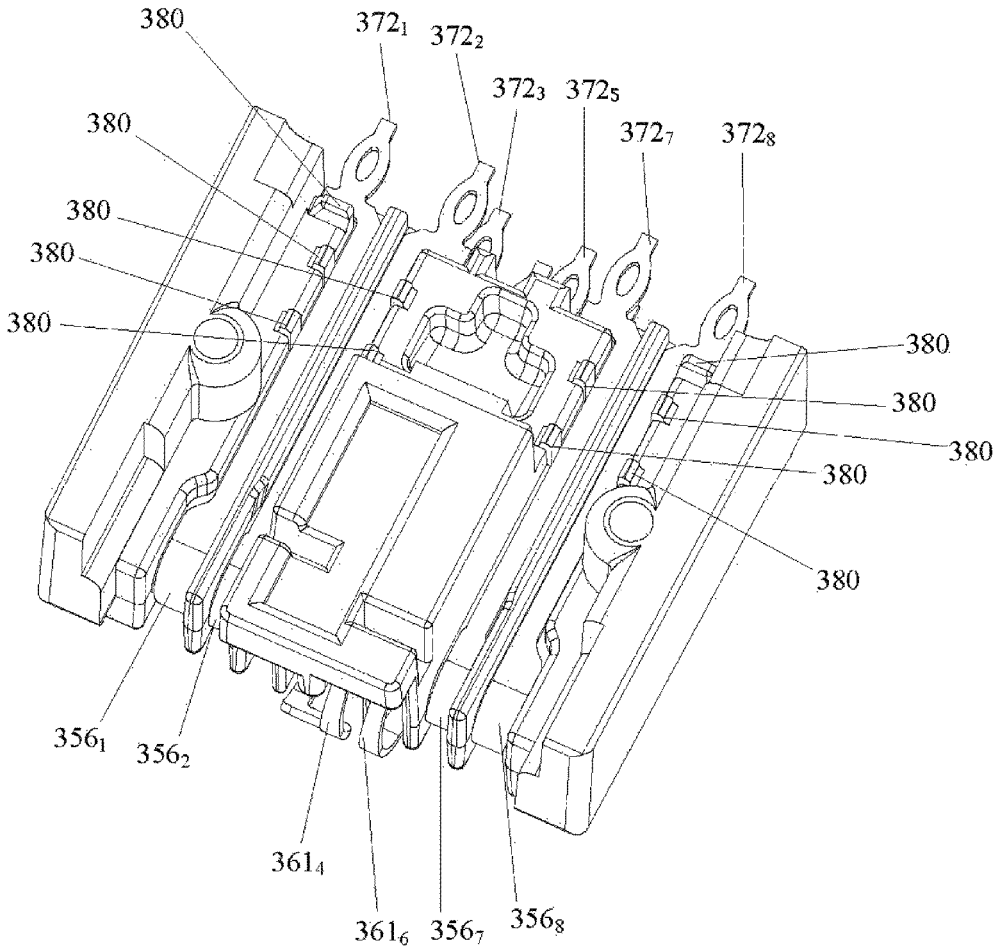
FIG. 31 illustrates a bottom isometric view of the front sled subassembly of FIG. 25.

FIG. 31 illustrates a bottom isometric view of front sled subassembly 344. PICs 356 are affixed to plastic sled 358 staking features 380.

Figure 32:
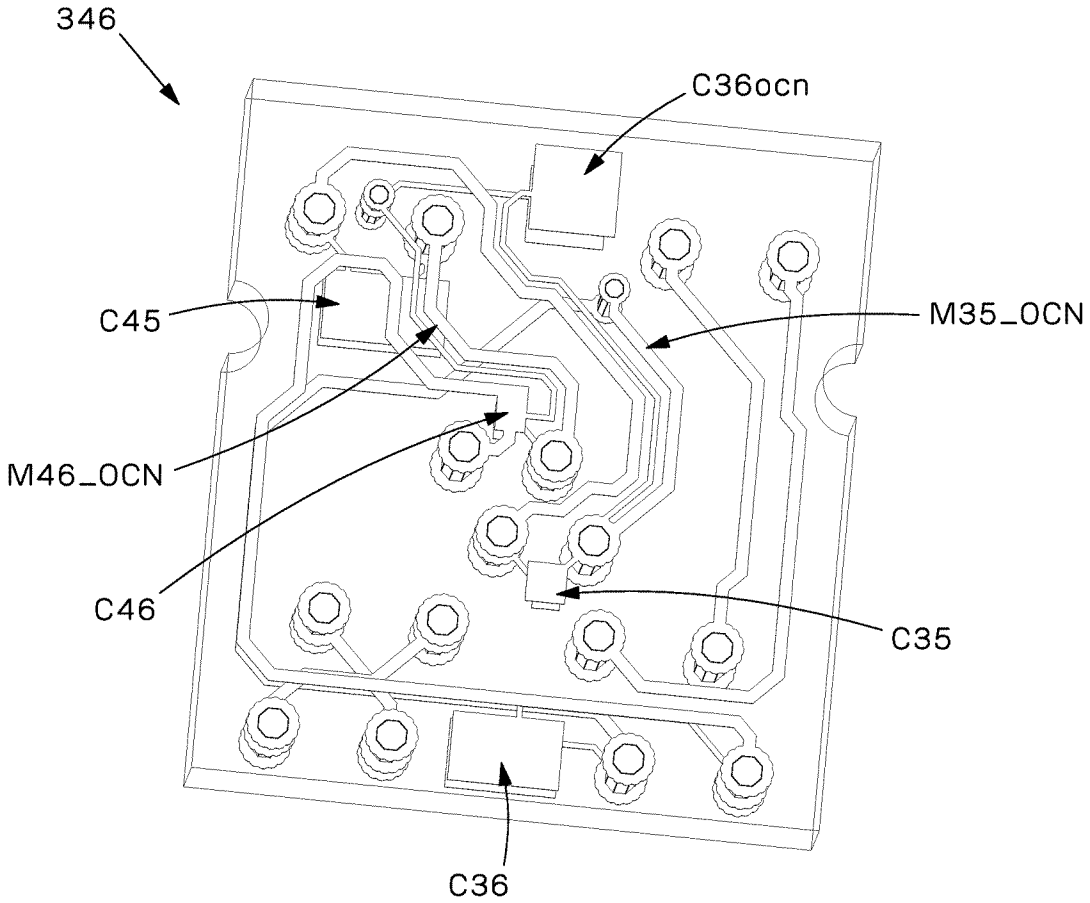
FIG. 32 illustrates a perspective view of an embodiment the printed circuit board of FIG. 25.
Figure 33:
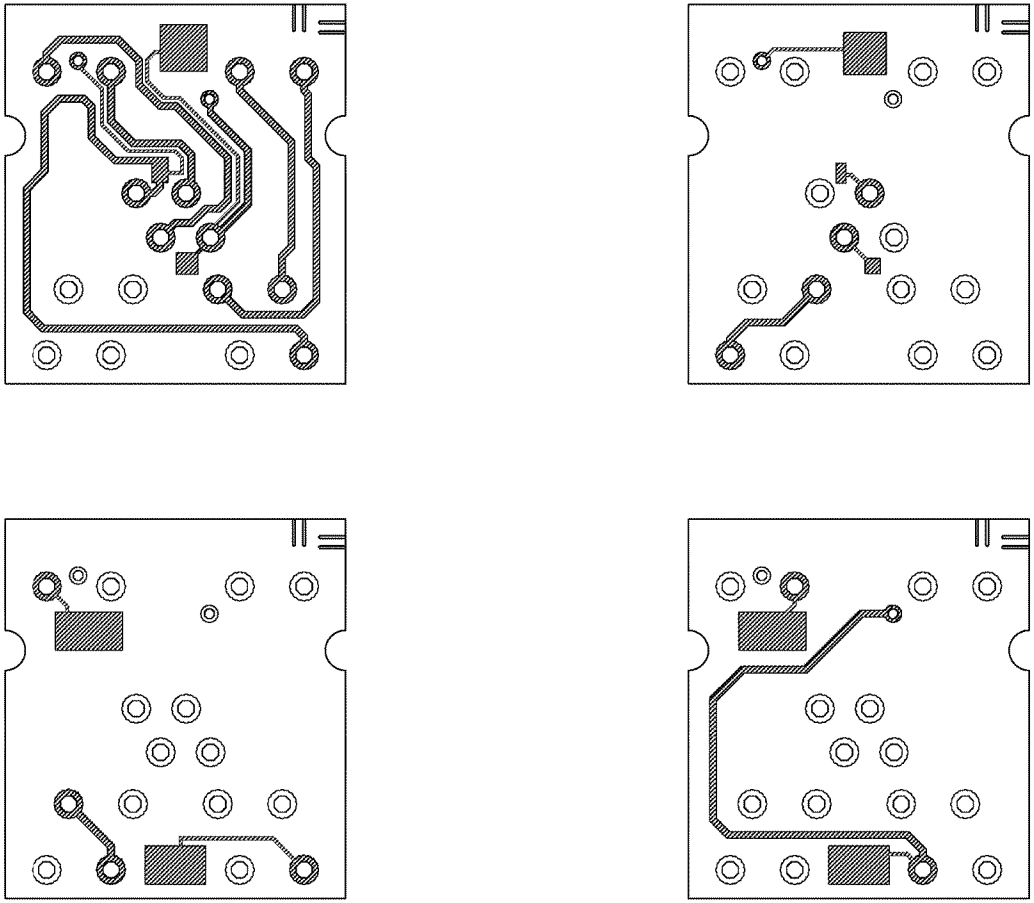
FIG. 33 illustrates a top view of the artwork for the four layers of the printed circuit board of FIG. 32.
Figure 34:
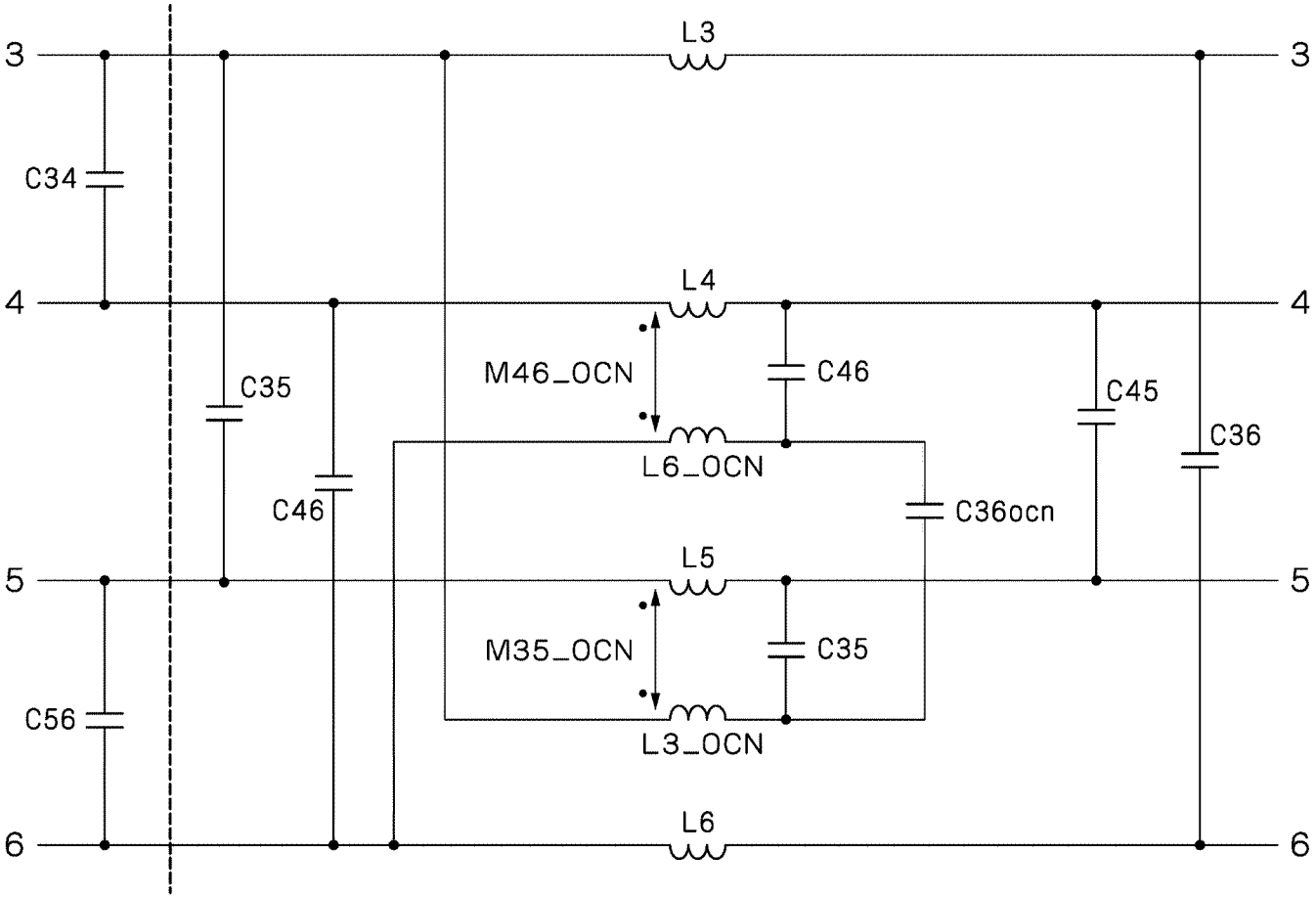
FIG. 34 illustrates a schematic view of the printed circuit board of FIG. 33.

FIGS. 32-34 illustrate the PCB layout for PCB, showing the compensation for pairs 3:6 and 4:5. Further, FIGS. 32-34 employ techniques similar to the method as shown in U.S. Patent Application Publication No. 2013/0130560 (Bolouri-Saransar et al.), entitled "Compensation Network Using an Orthogonal Compensation Network," filed on Nov. 20, 2012, and U.S. Patent Application Publication No. 2014/0011393 (Straka et al.), entitled "Communication Connector with Crosstalk Compensation," filed on May 30, 2013, both incorporated herein by reference in their entirety. Other pair combinations can employ single stage compensation, or may not require any compensation. All embodiments can be adapted to include such compensation methods, and/or other known methods such as two stage compensation.

Note that while this invention has been described in terms of several embodiments, these embodiments are non-limiting (regardless of whether they have been labeled as exemplary or not), and there are alterations, permutations, and equivalents, which fall within the scope of this invention. Additionally, the described embodiments should not be interpreted as mutually exclusive, and should instead be understood as potentially combinable if such combinations are permissive. It should also be noted that there are many alternative ways of implementing the methods and apparatuses of the present invention. It is therefore intended that claims that may follow be interpreted as including all such alterations, permutations, and equivalents as fall within the true spirit and scope of the present invention.

We claim:

1. A communication jack comprising:

a housing with an aperture for receiving a plug;

a first plug interface contact (PIC) and a second PIC positioned at least partially within said aperture, each of said first PIC and said second PIC including an end region proximal said aperture, said first PIC and said second PIC forming a first differential pair; and a third PIC and a fourth PIC positioned at least partially within said aperture, each of said third PIC and said fourth PIC including an end region proximal said aperture, said third PIC and said fourth PIC forming a second differential pair, said end region of said first PIC and said end region of said fourth PIC having an S-shape when viewed from a side, and said end region of said second PIC and said end region of said third PIC having a C-shape when viewed from said side.

2. The communication jack of claim 1, wherein said first PIC and said second PIC sandwich said third PIC and said fourth PIC.

3. The communication jack of claim 1, wherein said third PIC crosses over said fourth PIC in their respective said end regions.

4. The communication jack of claim 1, further including a contact region where each of said first, second, third, and fourth PICs interfaces with a respective plug contact of a corresponding communication plug, wherein in said contact region said third PIC and said fourth PIC are positioned adjacent to each other, said first PIC is positioned adjacent to said third PIC, and said second PIC is positioned adjacent to said fourth PIC, wherein said second PIC is positioned adjacent to said third PIC in at least a portion of their respective said end regions, and wherein said first PIC is positioned adjacent to said fourth PIC in at least a portion of their respective said end regions.

5. The communication jack of claim 1, wherein at least one of said first, second, third, and fourth PICs is supported in its respective said end region.

6. A communication jack comprising:

a housing with an aperture for receiving a plug;

a first plug interface contact (PIC) and a second PIC positioned at least partially within said aperture, each of said first PIC and said second PIC including an end region proximal said aperture and a fixed end fixed within said communication jack, said first PIC and said second PIC forming a first differential pair; and a third PIC and a fourth PIC positioned at least partially within said aperture, each of said third PIC and said fourth PIC including an end region proximal said aperture, a fixed end fixed within said communication jack, and an orthogonal jog in said end region, said third PIC and said fourth PIC forming a second differential pair, said third PIC crossing over said fourth PIC at said orthogonal jogs in their respective said end regions.

7. The communication jack of claim 6, further including a contact region where each of said first, second, third, and fourth PICs interfaces with a respective plug contact of a corresponding communication plug, wherein in said contact region said third PIC and said fourth PIC are positioned adjacent to each other, said first PIC is positioned adjacent to said third PIC, and said second PIC is positioned adjacent to said fourth PIC, wherein said second PIC is positioned adjacent to said third PIC in at least a portion of their respective said end regions, and wherein said first PIC is positioned adjacent to said fourth PIC in at least a portion of their respective said end regions.

8. The communication jack of claim 6, wherein at least one of said first, second, third, and fourth PICs is supported in its respective said end region.

9. The communication jack of claim 6, wherein said first PIC and said second PIC sandwich said third PIC and said fourth PIC.

10. The communication jack of claim 6, wherein at least one of said first, second, third, and fourth PICs does not provide a current path through its respective said end region.

11. The communication jack of claim 6, wherein at least one of said first, second, third, and fourth PICs has its respective said fixed end fixed within a printed circuit board (PCB), said PCB being fixed within said communication jack.

12. The communication jack of claim 6, wherein said orthogonal jog of said third PIC is in a direction different from a direction of said orthogonal jog of said fourth PIC.

13. The communication jack of claim 6, wherein said end region of said fourth PIC has an S-shape when viewed from a side.

14. The communication jack of claim 13, wherein said end region of said third PIC has a C-shape when viewed from said side.

15. A communication jack comprising:

a housing with an aperture for receiving a plug;

a first plug interface contact (PIC) and a second PIC positioned at least partially within said aperture, each of said first PIC and said second PIC including an end region proximal said aperture and a fixed end fixed within said communication jack, said first PIC and said second PIC forming a first differential pair;

a third PIC and a fourth PIC positioned at least partially within said aperture, each of said third PIC and said fourth PIC including an end region proximal said aperture and a fixed end fixed within said communication jack, said third PIC and said fourth PIC forming a second differential pair; and a contact region where each of said first, second, third, and fourth PICs interfaces with a respective plug contact of a corresponding communication plug, in said contact region said third PIC and said fourth PIC being positioned adjacent to each other, said first PIC being positioned adjacent to said third PIC, and said second PIC is positioned adjacent to said fourth PIC, said third PIC being deflected at an angle different from an angle of deflection of said fourth PIC when communication jack is mated with said corresponding communication plug.

16. The communication jack of claim 15, wherein at least one of said first, second, third, and fourth PICs does not provide a current path through its respective said end region.

17. The communication jack of claim 15, wherein said third PIC crosses over said fourth PIC in their respective said end regions.

18. The communication jack of claim 15, wherein said end region of said fourth PIC has an S-shape when viewed from a side.

19. The communication jack of claim 18, wherein said end region of said third PIC has a C-shape when viewed from said side.

20. The communication jack of claim 19, wherein said end region of said first PIC has an S-shape when viewed from a side, and said end region of said second PIC has a C-shape when viewed from said side.

* * * * *